US007031623B2

(12) United States Patent
Haramoto

(10) Patent No.: US 7,031,623 B2
(45) Date of Patent: Apr. 18, 2006

(54) IMAGE FORMING APPARATUS, MANAGEMENT METHOD FOR REPLACEMENT PART USED THEREFOR, AND MANAGEMENT PROGRAM FOR REPLACEMENT PART

(75) Inventor: Katsumi Haramoto, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/619,517

(22) Filed: Jul. 16, 2003

(65) Prior Publication Data

US 2004/0101320 A1 May 27, 2004

(30) Foreign Application Priority Data

Nov. 22, 2002 (JP) ..... 2002-339260

(51) Int. Cl.
*G03G 15/00* (2006.01)

(52) U.S. Cl. ..... 399/12; 399/8; 399/24

(58) Field of Classification Search ..... 399/12, 399/24, 8

See application file for complete search history.

(56) References Cited

U.S. PATENT DOCUMENTS

| | | | | |
|---|---|---|---|---|
| 4,961,088 | A * | 10/1990 | Gilliland et al. | 399/12 |
| 5,282,127 | A * | 1/1994 | Mii | 399/8 |
| 5,873,009 | A * | 2/1999 | Yamashita et al. | 399/8 |
| 5,890,029 | A * | 3/1999 | Hirata et al. | 399/8 |
| 5,894,416 | A * | 4/1999 | Kuroyanagi | 399/8 |
| 5,911,095 | A * | 6/1999 | Atsumi et al. | 399/8 |
| 6,009,284 | A * | 12/1999 | Weinberger et al. | 399/8 |
| 6,023,593 | A * | 2/2000 | Tomidokoro | 399/8 |
| 6,032,001 | A * | 2/2000 | Miyawaki | 399/8 |
| 6,317,570 | B1 * | 11/2001 | Uchida et al. | 399/8 |
| 6,317,848 | B1 * | 11/2001 | Sorens et al. | |
| 6,744,998 | B1 * | 6/2004 | McIntyre | 399/8 |
| 6,798,995 | B1 * | 9/2004 | Nagata | 399/8 |
| 2001/0055492 | A1 * | 12/2001 | Wood et al. | 399/8 |
| 2002/0025172 | A1 * | 2/2002 | Tsuda et al. | 399/8 |
| 2002/0051186 | A1 * | 5/2002 | Takahashi | |
| 2002/0152430 | A1 * | 10/2002 | Akasaka et al. | |
| 2003/0044184 | A1 * | 3/2003 | Yano et al. | 399/8 |

FOREIGN PATENT DOCUMENTS

| | | | |
|---|---|---|---|
| EP | 001066967 | A2 * | 1/2001 |
| JP | 2002062784 | A * | 2/2002 |
| JP | A 2002-062784 | | 2/2002 |
| JP | 2002111943 | A * | 4/2002 |
| JP | A 2002-202697 | | 7/2002 |
| JP | 2002288389 | A * | 10/2002 |
| JP | 2002328580 | A * | 11/2002 |

* cited by examiner

*Primary Examiner*—Susan Lee
(74) *Attorney, Agent, or Firm*—Oliff & Berridge, PLC

(57) ABSTRACT

To provide an image forming apparatus in which: a memory having a large capacity becomes unnecessary, and many types of information such as a type of replacement part can be utilized for the control of an image forming apparatus or the like. Therefore, a replacement part including a storage medium into which identification information inherent to the replacement part is written; and an apparatus main body having a communication unit that serves to communicate with the storage medium of the replacement part; an information acquisition unit that, based on the identification information obtained from the storage medium of the replacement part through the communication unit, acquires information on the replacement part from a storage unit provided to an element other than the replacement part; and a management unit that manages a usage state of the replacement part in accordance with the information on the replacement part acquired by the information acquisition unit.

34 Claims, 16 Drawing Sheets

Fig.11

| replacement part | identification information |
|---|---|
| developer cartridge 04Y | 0000000001 |
| developer cartridge 04M | 0000000002 |
| developer cartridge 04K | 0000000003 |
| developer cartridge 04C | 0000000004 |
| | |

Fig.15

| name of replacement part | identification information | information concerning the usage state of a replacement part | | | | | |
|---|---|---|---|---|---|---|---|
| | | kind of a cartridge | color of toner | identification of device models | life counter | number of paper jam occurrence | number of recycled times |
| cartridge | 0000000001 | ##2 | Y | FX5 | 0055 | 00 | 0 |
| | 0000000002 | ##2 | M | FX5 | 0060 | 00 | 0 |
| | 0000000003 | ##3 | C | FX6 | 0100 | 00 | 1 |
| | 0000000004 | ##2 | K | FX5 | 0045 | 00 | 0 |
| | | | | | | | |

IMAGE FORMING APPARATUS, MANAGEMENT METHOD FOR REPLACEMENT PART USED THEREFOR, AND MANAGEMENT PROGRAM FOR REPLACEMENT PART

FIELD OF THE INVENTION AND RELATED ART STATEMENT

The present invention relates to an image forming apparatus such as a printer and a copying machine constructed such that a replacement part such as a toner cartridge is detachably mountable to an apparatus main body, a management method for a replacement part used for the image forming apparatus, and a management program for a replacement part. More specifically, the present invention relates to an image forming apparatus in which a storage medium that retains information on a replacement part is attached to a replacement part main body and the information on the replacement part is used for controlling an apparatus main body, a management method for a replacement part used for the image forming apparatus, and a management program for a replacement part.

In recent years, in the above-mentioned image forming apparatus such as a printer and a copying machine, there has been a general tendency, for example, to input information on the replacement part such as a toner cartridge to the apparatus main body and control the apparatus based on the input information in order to increase the commercial value of the apparatus or improve the operability. For example, according to a conventional technique, in a network printer connected to a personal computer, information on the toner remaining amount of a toner cartridge or the like is inputted to a printer main body. The input information is transmitted to a host computer, and the toner remaining amount is displayed on a monitor of a user interface for the host computer, so that a user can readily know the time to replace the toner cartridge.

Also, in the above-mentioned image forming apparatus such as a printer and a copying machine, information on replacement parts such as toner cartridges is inputted to the apparatus main body in order to distinguish various replacement parts from each other or distinguish kinds of toner in the toner cartridges from each other.

As a method of inputting the information on the replacement part to the apparatus main body and controlling the apparatus based on the input information as described above, the replacement part such as a toner cartridge may be provided with a storage medium that can be used for transmitting information to the apparatus main body.

A drawer connector is generally used as a conventional coupling unit for transmitting information between the storage medium provided to the above-mentioned replacement part such as a toner cartridge and the apparatus main body. This is because the drawer connector can be electrically connected in association with the mounting of the replacement part.

However, if the drawer connector is used as the coupling unit for transmitting the information between the storage medium provided to the replacement part such as a toner cartridge and the apparatus main body as described above, the following problems arise.

1) The drawer connector is basically connected in one direction and therefore the direction for connecting the replacement part is restricted. For example, a toner cartridge is generally inserted in an axial direction of the apparatus main body, then turned by a predetermined angle, and set.

However, it is mechanically impossible to connect the drawer connector by such operation because the drawer connector is basically connected in one direction.

2) The drawer connector requires a certain force for the connection, which may impair operability of the replacement part. Also, the drawer connector may be operated with different kinds of forces for different parts at the time of the connection, and the user may judge by mistake that the mounting is complete though the replacement part is not completely mounted, which results in a mounting fault.

3) If toner or the like adheres to the connecting portion of the drawer connector, a connection fault may occur.

4) When there are multiple replacement parts in the image forming apparatus, drawer connectors dedicated to each of the multiple replacement parts are necessary, which increases the size and cost of the apparatus.

5) It is difficult to reduce the size of the storage medium provided to the replacement part, because the storage medium is connected by using a drawer connector. The drawer connector having about six to ten pins needs to be used, with the result that the drawer connector becomes large in size, which increases the size and cost of the replacement parts.

6) If the replacement part such as a toner cartridge is mounted to a rotary member in a rotary developing apparatus or the like, the rotary part and the stationary part must be electrically connected therebetween, and therefore the reliability at the contact between the rotary part and the stationary part becomes lower.

In view of the above, the applicant of the present invention has already proposed a technique disclosed in JP 2002-62784 A in order to solve the above-mentioned problems, which provides: an image forming apparatus in which a direction of connecting the replacement part is not restricted; the operability of the replacement part is not lowered; the sizes and costs of the apparatus and the replacement parts are not increased so that the information on the replacement part can be reliably inputted to the apparatus main body; and a replacement part used for the image forming apparatus.

Further, other techniques capable of solving the above-mentioned problems have already been disclosed in JP 2002-202697 A, etc.

A replacement part according to JP 2002-62784 A that is replaced periodically and detachably mountable to an image forming apparatus is characterized by including a storage medium that stores information on the replacement part, the information stored in the storage medium being at least readable on an image forming apparatus main body side by a communication unit for communicating through a radio wave.

Further, a replacement part according to JP 2002-202697 A is used for a method of discriminating a genuine article characterized by allowing a programmed computer to execute: a step of detecting inherent information for identifying the replacement part mounted to the device through a network; and a step of accessing a storage unit with the inherent information registered therein, and comparing the inherent information detected above with the registered inherent information to thereby judge whether or not the replacement part mounted to the above-mentioned device is a genuine part registered in the storage unit.

However, the above-mentioned conventional techniques have the following problems. That is, according to the technique disclosed in JP 2002-62784 A, the replacement part includes the storage medium that stores the information on the replacement part, and is structured such that the information stored in the storage medium is at least readable on the image forming apparatus main body side by the communication unit for communicating through a radio wave. However, the storage medium provided to the above-mentioned replacement part is inputted with many types of information such as a type of replacement part; a color identification of toner or the like; a model identification; and a life counter. As a result, a memory having a large capacity is necessary. Accordingly, there arise such problems: increase in its cost; increase in number of man-hours such as time for writing or reading data; and the like.

Further, the technique disclosed in JP 2002-202697 A described above includes a structure for allowing the programmed computer to execute: a step of detecting the inherent information for identifying the replacement part mounted to the device through a network; and a step of accessing the storage unit with the inherent information registered therein, and comparing the inherent information detected above with the registered inherent information to thereby judge whether or not the replacement part mounted to the above-mentioned device is a genuine part registered in the storage unit. However, even if the storage medium is mounted to the replacement part, the storage medium stores only the inherent information for identifying the replacement part. Accordingly, there arises problem in that although whether or not the replacement part is a genuine part can be judged, many types of information such as a type of replacement part, a color identification of toner or the like, a model identification, and a life counter cannot be utilized for the control of an image forming apparatus or the like.

OBJECT AND SUMMARY OF THE INVENTION

The present invention has been made in view of the above circumstances and provides an image forming apparatus in which: necessary and minimum information is stored in a storage medium provided to a replacement part to eliminate the necessity of a memory having a large capacity, thereby preventing an increase in its cost or an increase in number of man-hours such as time for writing or reading data; and many types of information such as a type of replacement part, a color identification of toner or the like, a model identification, and a life counter can be utilized for the control of an image forming apparatus or the like. The present invention also provides a management method for a replacement part used for the image forming apparatus, and a management program for a replacement part.

In order to realize the above, according to an aspect of the present invention, as shown in FIG. 1, the image forming apparatus has:

at least one replacement part including a storage medium that can store information and into which identification information inherent to the replacement part is written; and an apparatus main body to which the replacement part is detachably mountable, and which includes:

a communication unit that serves to communicate the information with the storage medium of the replacement part;

an information acquisition unit that, based on the identification information obtained from the storage medium of the replacement part through the communication unit, acquires information on the replacement part from a storage unit provided to an element other than the replacement part; and a management unit that manages a usage state of the replacement part in accordance with the information on the replacement part acquired by the information acquisition unit.

Therefore, according to the present invention, the storage medium of the replacement part may only store the identification information inherent thereto, and does not need to store many types of information such as a type of replacement part, a color identification of toner or the like, a model identification, and a life counter. Thus, a memory having a large capacity becomes unnecessary. Accordingly, it is possible to prevent the increase in cost or the increase in number of man-hours such as time for writing or reading data. In addition, the many types of information on the replacement part, such as a type of replacement part, a color identification of toner or the like, a model identification, and a life counter, may be stored into the storage unit provided to an element other than the replacement part. Thus, the many types of information such as a type of replacement part, a color identification of toner or the like, a model identification, and a life counter can be retained and utilized for the control of the image forming apparatus or the like. Accordingly, the suitable control and operability of the apparatus can be improved.

Further, according to another aspect of the present invention, in the management method for a replacement part in which the replacement part detachably mountable to an apparatus main body is managed by communicating information through a communication unit between a control unit of the apparatus main body and a storage medium of the replacement part capable of storing the information, the method has:

storing identification information inherent to the replacement part into the storage medium of the replacement part;

in correspondence with the identification information, storing information for managing a usage state of the replacement part into a storage unit provided to an element other than the replacement part;

reading the identification information of the replacement part stored in the storage medium of the replacement part;

based on the identification information read from the replacement part, acquiring the information on a corresponding replacement part stored in the storage unit; and based on the information on the corresponding replacement part acquired from the storage unit, managing a usage state of the replacement part.

Still further, according to another aspect of the present invention, in the management program for a replacement part for allowing a computer to execute a process of managing the replacement part detachably mountable to an apparatus main body by communicating information through a communication unit between a control unit of the apparatus main body and a storage medium of the replacement part capable of storing the information, the method has:

reading identification information of the replacement part stored in the storage medium of the replacement part;

based on the identification information read from the replacement part, acquiring the information on a corresponding replacement part stored in a storage unit provided to an element other than the replacement part; and based on the information on the corresponding replacement part acquired from the storage unit, managing a usage state of the replacement part.

According to the above-mentioned aspects of the present invention, necessary and minimum information can be stored in the storage medium of the replacement part. In addition, the information on the replacement part is stored in the storage unit provided to an element other than the replacement part. Accordingly, a memory having a large capacity becomes unnecessary, thereby preventing the increase in cost or the increase in number of man-hours such as time for writing or reading data. Also, many types of information such as a type of replacement part, a color identification of toner or the like, a model identification, and a life counter can be utilized for the control of an image forming apparatus or the like.

As has been described above, according to the present invention, there can be provided an image forming apparatus in which: necessary and minimum information is stored in a storage medium provided to a replacement part to eliminate the necessity of a memory having a large capacity, thereby preventing the increase in cost or the increase in number of man-hours such as time for writing or reading data; and many types of information such as a type of replacement part, a color identification of toner or the like, a model identification, and a life counter can be utilized for the control of an image forming apparatus or the like. The present invention can also provide a management method for a replacement part used for the image forming apparatus, and a management program for a replacement part.

BRIEF DESCRIPTION OF THE DRAWINGS

Preferred embodiments of the present invention will be described in detail based on the following drawings, wherein:

FIG. 11 is a chart showing identification information of replacement parts;

FIG. 15 is a chart showing identification information of a replacement part and information on the usage state of the replacement part, which are stored in a storage unit;

DETAILED DESCRIPTION OF THE PREFERRED EMBODIMENTS

Hereinafter, description will be made of embodiments of the present invention with reference to the drawings.

Embodiment 1

Figure 1:
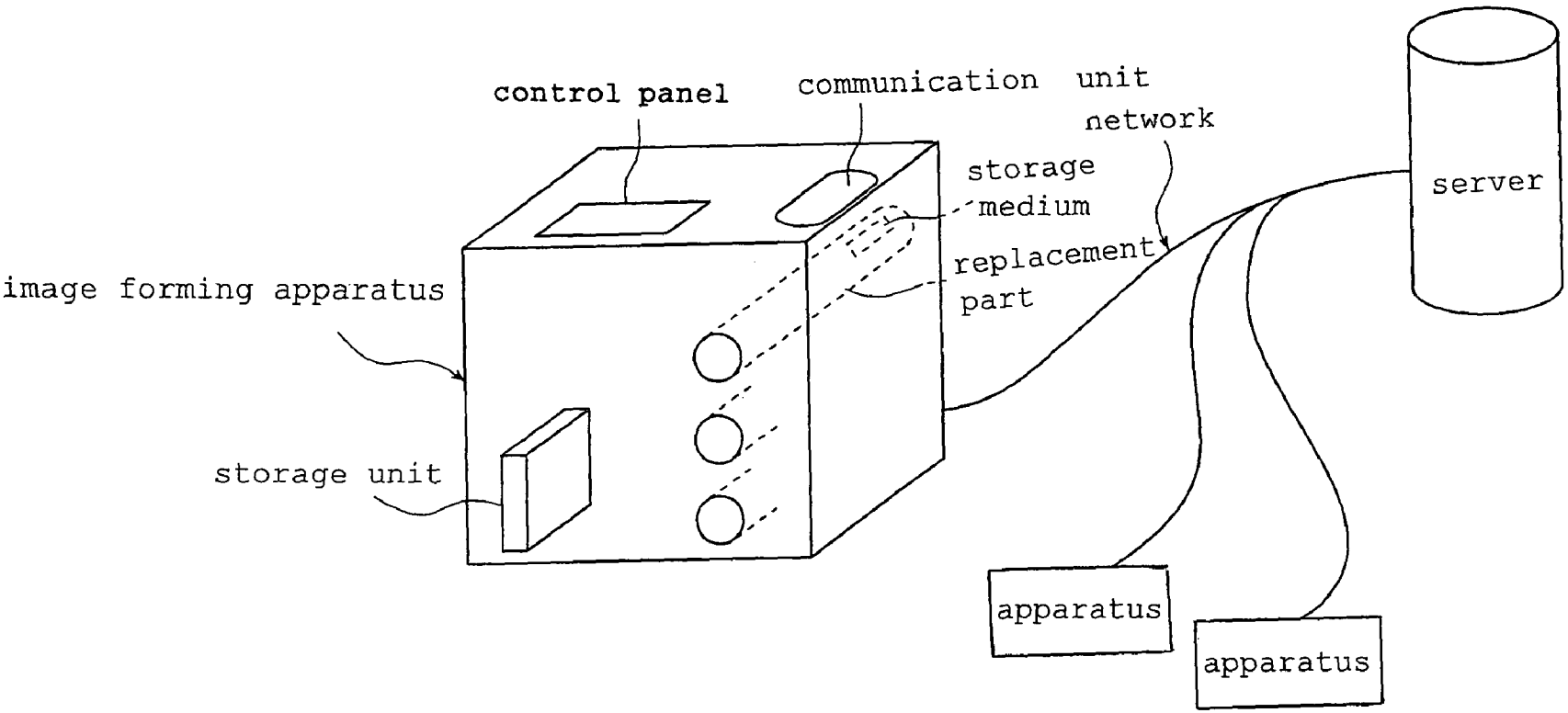
FIG. 1 is a schematic structural view showing a tandem-type full-color printer as an image forming apparatus according to Embodiment 1 of the present invention.
Figure 2:
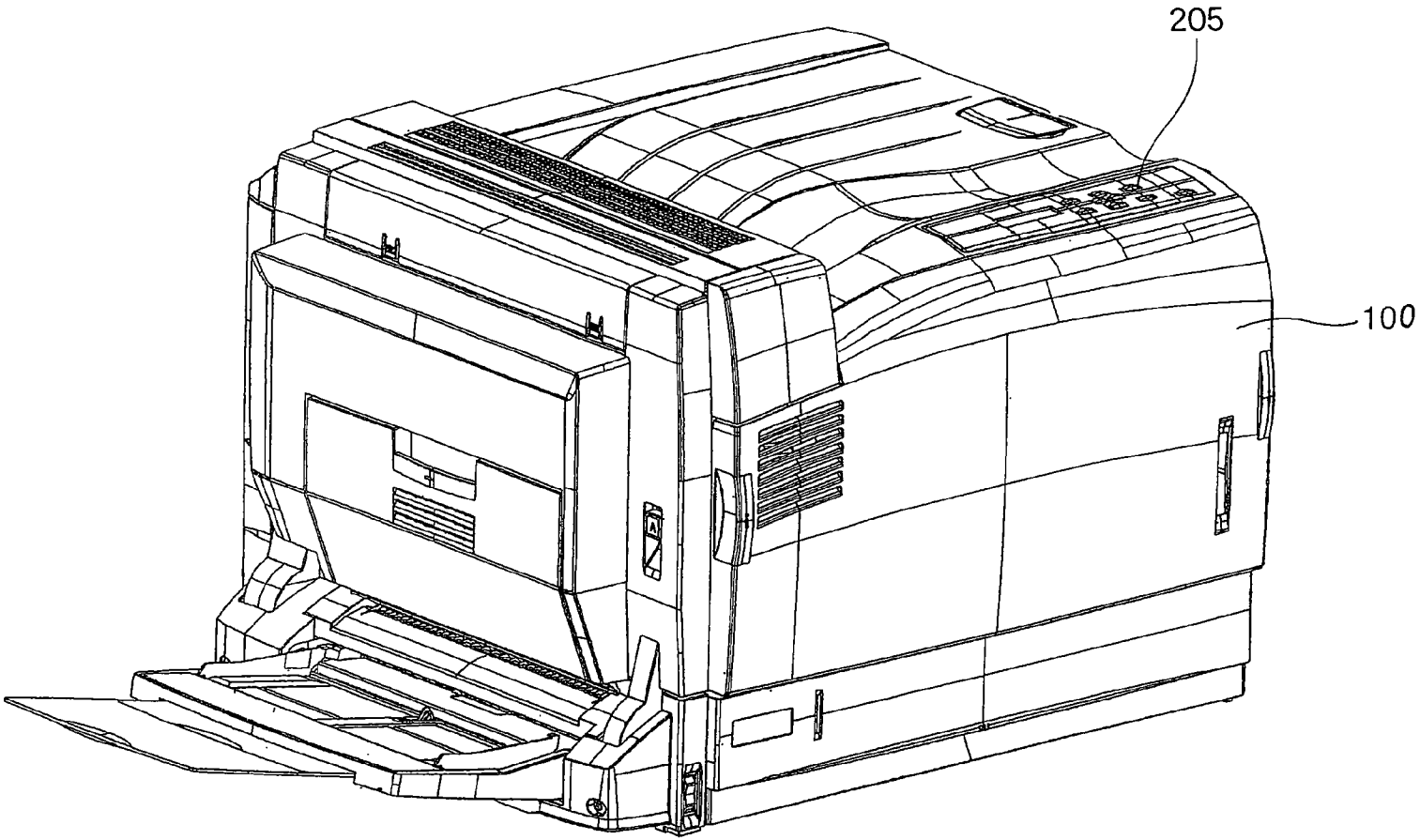
FIG. 2 is a perspective view showing an outer appearance of the tandem-type full-color printer as the image forming apparatus according to Embodiment 1 of the present invention.

FIG. 2 is a perspective view showing an outer appearance of a tandem-type full-color printer 100 serving as an image forming apparatus to which a management system of replacement parts according to Embodiment 1 of the present invention is applied.

Figure 3:
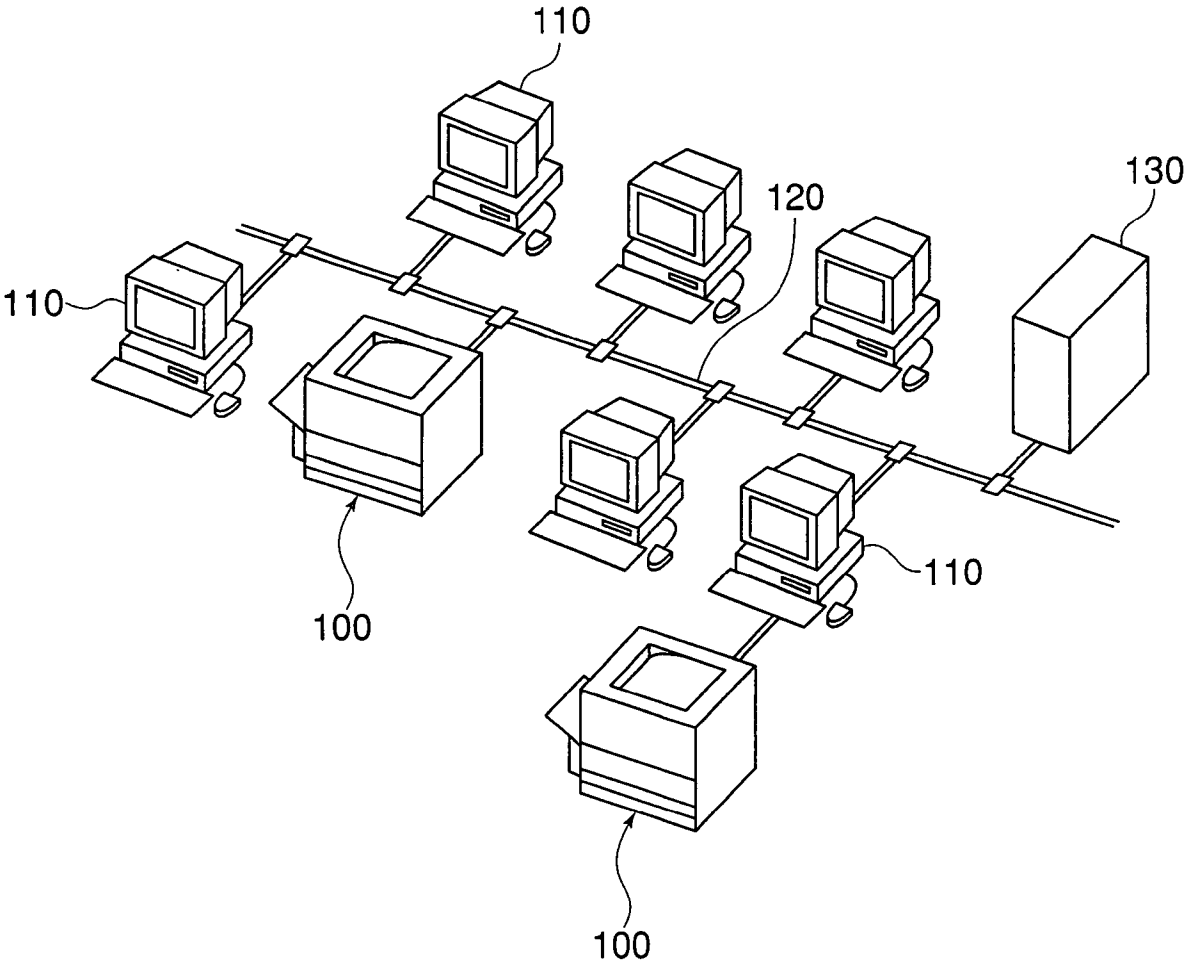
FIG. 3 is an explanatory view showing a usage state of the tandem-type full-color printers as the image forming apparatuses according to Embodiment 1 of the present invention.

As shown in FIG. 3, the above-mentioned full-color printers 100 are directly connected, for example, to image reading devices such as scanners, personal computers 110, and the like. Based on image data sent from the personal computers 110, the full-color printers 100 are employed to output color or monochrome images as a matter of course. Further, the full-color printers 100 are also connected to a server 130 on the user side via a network 120 structured by a LAN, a telephone line, etc., so that the printers can operate based on image information or other data information sent via the network 120.

Figure 4:
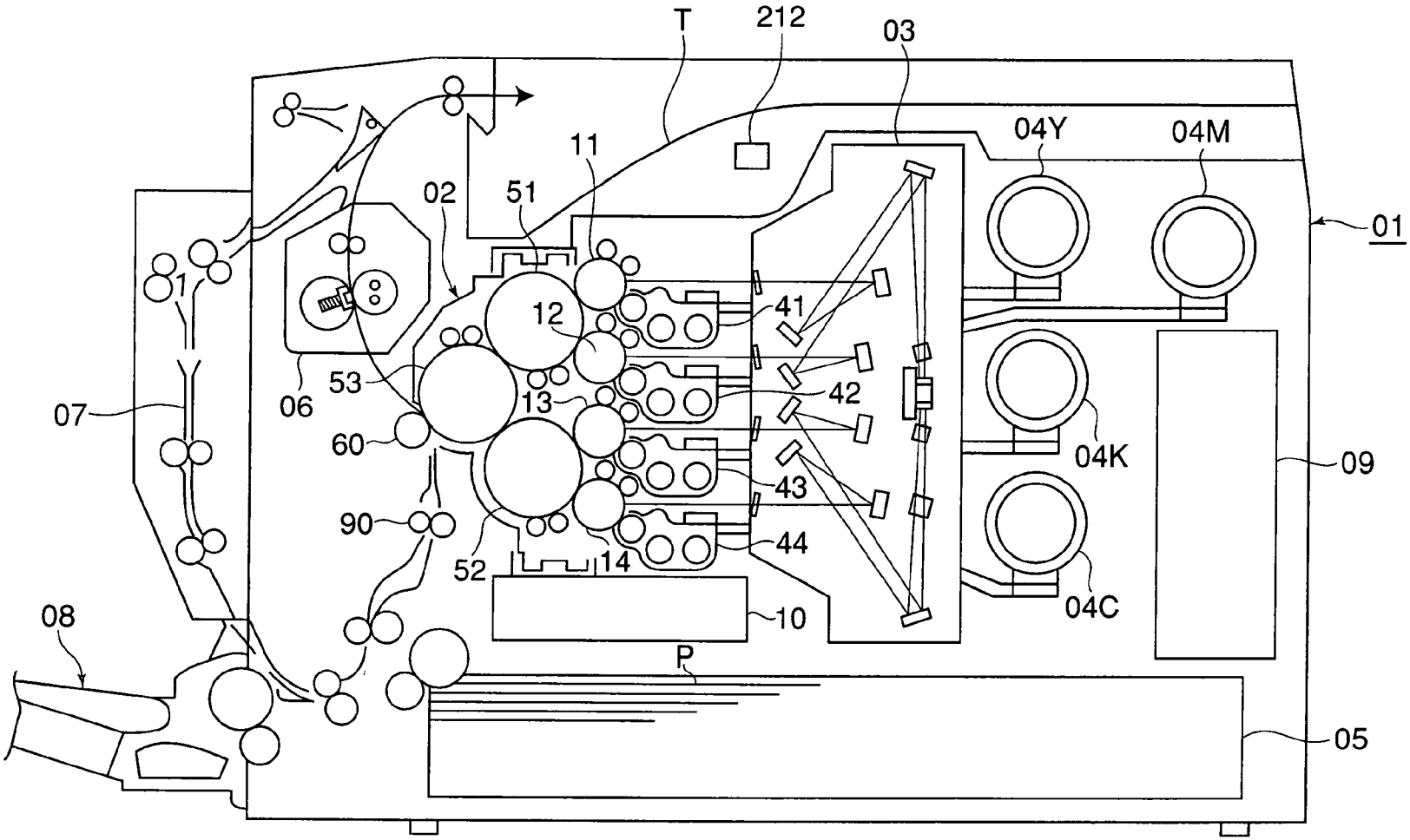
FIG. 4 is a structural view showing the tandem-type full-color printer as the image forming apparatus according to Embodiment 1 of the present invention.

FIG. 4 is a structural diagram of a tandem-type full-color printer serving as an image forming apparatus to which the management system of replacement parts according to Embodiment 1 of the present invention is applied.

In FIG. 4, reference numeral 01 denotes a main body of the tandem-type full-color printer (printer main body). Inside the printer main body 01, there are basically provided: a print head device 02 that performs full-color image formation; a raster output scanner (ROS: exposure device) 03 that conducts image exposure on four photosensitive drums (image bearing bodies) 11, 12, 13, and 14 of the print head device 02; four developer cartridges 04Y, 04M, 04K, and 04C that supply toner of a corresponding color to developing devices 41, 42, 43, and 44 of different colors in the print head device 02; a paper feeding cassette 05 with which a transfer paper P as a transfer material is fed to the print head device 02; a fixing device 06 that conducts fixing process on the transfer paper P on which a toner image is transferred from the print head device 02; a duplex printing transport path 07 through which the transfer paper P having an image fixed on one side thereof by the fixing device 06 is transported again to the transfer part of the print head device 02 in a state where the surface of the transfer paper P is reversed; manual paper feeding unit 08 with which a desired transfer paper P is fed from the outside of the printer main body 01; a controller 09 composed of a control circuit that controls operation of the printer, an image processing circuit that conducts image processing on image signals, etc; and an electric circuit 10 composed of a high voltage power supply circuit, etc. Note that, in FIG. 2, reference symbol T denotes a discharge tray with which the transfer paper P having the image formed thereon is discharged. The discharge tray T is integrally located in the upper part of the printer main body 01.

Among various components arranged inside the printing main body 01, the ROS 03 as the exposure device is structured by: four semiconductor lasers driven to be illuminated based on image data each corresponding to a color of yellow (Y), magenta (M), black (K), or cyan (C) ; a f-θ lens, polygon mirror, or reflection mirror composed of plural mirror sheets, that performs deflection scanning of four laser beams emitted from the four semiconductor lasers; and the like.

Figure 5:
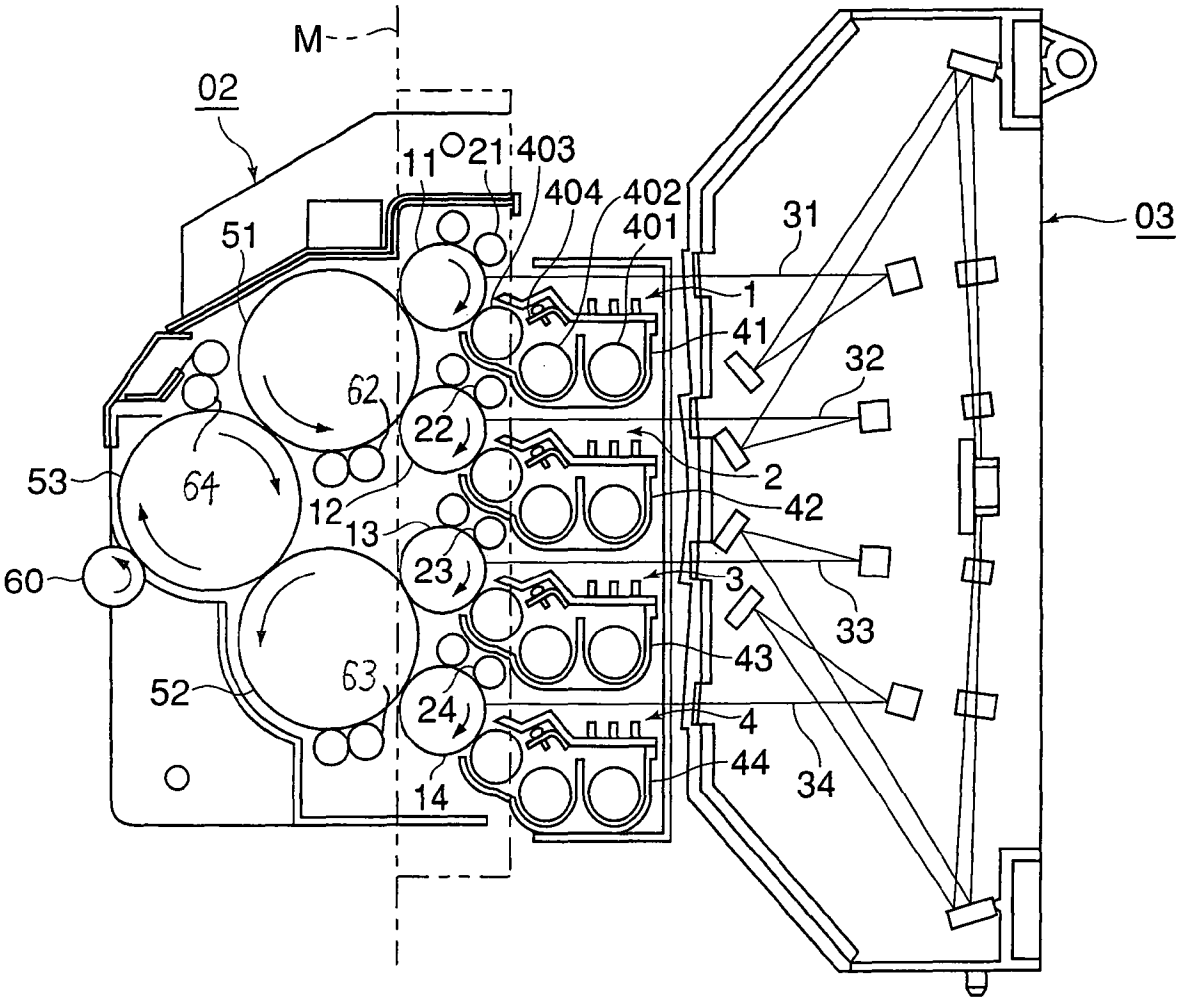
FIG. 5 is a structural view showing an image forming part of the tandem-type full-color printer as the image forming apparatus according to Embodiment 1 of the present invention.

FIG. 5 is a diagram showing the print head device of the tandem-type full-color printer serving as an image forming apparatus according to Embodiment 1 of the present invention. Note that, arrows shown in FIG. 5 respectively indicate a rotating direction of each rotary component.

As shown in FIG. 5, a main part of the print head device 02 is constituted by: image formation parts 1, 2, 3, and 4 including photosensitive drums (image bearing bodies) 11, 12, 13, and 14 for the respective colors of yellow (Y), magenta (M), black (K), and cyan (C); primary charge charging rolls (contact-type charging devices) 21, 22, 23, and 24 that contact the photosensitive drums 11, 12, 13, and 14; the ROS (exposure device) 03 (see FIG. 4) that performs irradiation of laser beams 31, 32, 33, and 34 of the respective colors of yellow (Y), magenta (M), black (K), and cyan (C); developing devices 41, 42, 43, and 44 that develop electrostatic latent images formed on the photosensitive drums 11, 12, 13, and 14 with corresponding toner of the respective colors of yellow (Y), magenta (M), black (K), and cyan (C); a first primary intermediate transfer drum (image bearing body) 51 as an intermediate transfer body that contacts two photosensitive drums 11 and 12 among the four photosensitive drums 11, 12, 13 and 14; a second primary intermediate transfer drum (image bearing body) 52 as another intermediate transfer body that contacts the other two photosensitive drums 13 and 14; a secondary intermediate transfer drum (image bearing body) 53 as still another intermediate transfer body that contacts the first and second primary intermediate transfer drums 51 and 52; and a final transfer roll (transfer electric field imparting rotary member) 60 that contacts the secondary intermediate transfer drum 53.

The photosensitive drums 11, 12, 13, and 14 are arranged at constant intervals so as to have a common tangent plane M. The first primary intermediate transfer drum 51 and the second primary intermediate transfer drum 52 are arranged such that rotary shafts thereof are parallel to the shafts of the photosensitive drums 11, 12, 13, and 14, and satisfy a relation of plane symmetry with respect to a predetermined plane of symmetry as a boundary. The secondary intermediate transfer drum 53 is arranged such that the rotary shaft thereof is parallel to those of the photosensitive drums 11, 12, 13, and 14.

Signals corresponding to image information of the respective colors are rasterized by the image processing circuit arranged in the electric circuit 10. (see FIG. 4) before being inputted to the ROS 03. In the ROS 03, the laser beams 31, 32, 33, and 34 of the respective colors of yellow (Y), magenta (M), black (K), and cyan (C) are modulated, and each of the photosensitive drums 11, 12, 13, and 14 is irradiated with the modulated laser beam having the corresponding color.

In the circumference of the respective photosensitive drums 11, 12, 13, and 14, image formation process is performed with a known electrophotographic system for each color. First, as the photo sensitive drums 11, 12, 13, and 14, for example, a photosensitive drum made of an OPC photosensitive body having a diameter of 30 mm is employed. Such photosensitive drums 11, 12, 13, and 14 are driven to rotate at a rotating velocity of 104 mm/sec, for instance. As shown in FIG. 5, the surfaces of the photosensitive drums 11, 12, 13, and 14 are charged to about −500 V, for example, by application of a DC voltage of about −1000 V to the charging rolls 21, 22, 23, and 24 as contact-type charging devices. As the contact-type charging devices, there are roll-type, film-type, brush-type, and other types of devices, but any type may preferably be used. In this embodiment, charging rolls are adopted, which are generally being used in an electrophotographic device in recent years. Also, in this embodiment, to perform charging of the surfaces of the photosensitive drums 11, 12, 13, and 14, a charging system using application of only a DC voltage is adapted, but a charging system using application of an AC voltage and a DC voltage may also be employed.

After that, the surfaces of the photosensitive drums 11, 12, 13, and 14 are irradiated by the ROS 03 as the exposure device with the laser beams 31, 32, 33, and 34 for the respective colors of yellow (Y), magenta (M), black (K), and cyan (C). As a result, electrostatic latent images corresponding to inputted image information for the respective colors are formed on the surfaces of the photosensitive drums 11, 12, 13, and 14. In the photosensitive drums 11, 12, 13, and 14, surface potentials of the image exposure parts thereof decrease to about −100 V or lower by charge elimination at the time of the formation of the electrostatic latent images by the ROS 03.

The electrostatic latent images of the respective colors of yellow (Y), magenta (M), black (K), and cyan (C) formed on the photosensitive drums 11, 12, 13, and 14 are developed by one of the developing devices 41, 42, 43, and 44 having a corresponding color. As a result, toner images of the respective colors of yellow (Y), magenta (M), black (K), and cyan (C) are formed on the photosensitive drums 11, 12, 13, and 14.

In this embodiment, as the developing devices 41, 42, 43, and 44, a magnetic brush contact-type two-component developing system is adapted. However, the applicable range of the present invention is not limited to this developing system. It is of course possible that a non-contacting-type developing system can satisfactorily be applied to the present invention.

The developing devices 41, 42, 43, and 44 are each filled with a developer composed of a different color toner, i.e., yellow (Y), magenta (M), black (K), or cyan (C), and carriers. As shown in FIG. 4, in the developing devices 41, 42, 43, and 44, when toner for a corresponding color is replenished from each of the developer cartridges 04Y, 04M, 04K, and 04C, the replenished toner is sufficiently stirred with the carriers by augers 401 and 402 to have triboelectrification charge. Inside each of developing rolls 403 there are arranged magnet rolls (not-shown) having plural magnetic poles set at a given angle in a fixed state. The developer fed to the vicinity of the surface of the developing roll 403 by the auger 402, which feeds the developer to the developing roll 403, is regulated in amount to be fed to the developing part by a developer amount regulating member 404. In this embodiment, the amount of developer is set to about 4 to 5 g/m$^2$. The charge amount of the toner present on the developing roll 403 is in the order of approximately −30 to 50 μC/g.

The toner supplied on the developing roll 403 is in the form of a magnetic brush formed by the carriers and toner by the magnetic force of the magnet roll, and this magnetic brush is in contact with the photosensitive drums 11, 12, 13, and 14. The electrostatic latent images formed on the photosensitive drums 11, 12, 13, and 14 are each developed with toner on the developing roll 403 of a corresponding color by application of a developing bias voltage of AC+DC to the developing roll 403, resulting in formation of toner images. In this embodiment, for example, an AC component of the developing bias voltage is set to 4 kHz and 1.6 kVpp whereas a DC component thereof is set to about −300 V.

In this embodiment, in the developing devices 41, 42, 43, and 44, so-called "spherical toner" having a substantial spherical shape with the average particle diameter of about 3 to 10 μm is used as toner. For example, the particle average diameter of black toner is set to about 8 μm, and that of color toner is set to about 7 μm.

As the above-mentioned toner, there is used, for example, one prepared by using polystyrene (PS) as a main component to be formed into a spherical shape by polymerization. The toner used in this embodiment has the toner shape coefficient of 120 or lower, which is defined by the following formula.

$$\text{The toner shape coefficient}=((\text{toner particle diameter maximum length})^2\times\pi/(4\times\text{toner project area}))\times 100$$

Next, the toner images of the respective colors of yellow (Y), magenta (M), black (K), and cyan (C) formed on the photosensitive drums 11, 12, 13, and 14 are electrostatically subjected to secondary transfer on the first primary intermediate transfer drum 51 and the second primary intermediate transfer drum 52 of those, the toner images of yellow (Y) and magenta (M) formed on the photosensitive drums 11 and 12 are transferred on the first primary intermediate transfer drum 51. Then, the toner images of black (K) and cyan (C) formed on the photosensitive drums 13 and 14 are transferred on the second primary intermediate transfer drum 52. Accordingly, formed on the first primary intermediate transfer drum 51 is a single-color image transferred from the photosensitive drum 11 or the photosensitive drum 12, or a two-color image obtained by overlapping the toner images of the two colors transferred from both the photosensitive drums 11 and 12. Similar to the above, a single-color image or a two-color image is formed on the second primary intermediate transfer drum 52 through transfer from the photosensitive drums 13 and 14.

The surface potential required for the electrostatic transfer of the toner images from the photosensitive drums 11, 12, 13, and 14 on the first and second primary intermediate transfer drums 51 and 52, is in the order of +250 to 500 V. This surface potential is set to an optimal value depending on the charge condition of toner, ambient temperature, and humidity. The ambient temperature and humidity can easily be found by detecting a resistance value of a member having a characteristic in which the resistance value thereof varies depending on the ambient temperature and humidity. As described above, in a case where the charge amount of toner is in the range from −30 to 50 μC/g under a normal temperature and a normal humidity, the surface potentials of the first and second primary intermediate transfer drums 51 and 52 are preferably set to about +400 V.

The first and second primary intermediate transfer drums 51 and 52 used in this embodiment are each set to have the outer diameter of 60 mm and a resistance value of about $10^8$ Ω, for example. Further, the first and second primary intermediate transfer drums 51 and 52 are each a cylindrical rotary member having elasticity in the surface, which is formed by a single layer or plural layers. In general, the transfer drum is formed by covering a metal pipe made of Fe, Al, etc., as a metal core, with a low resistance elastic rubber layer (R=$10^2$ to $10^3$ Ω), typically conductive silicone rubber layer or the like having a thickness of about 0.1 to 10 mm. Furthermore, the outmost surface of the respective first and second primary intermediate transfer drums 51 and 52 is formed as a layer of high release properties (ρv=$10^{11}$ to $10^{13}$ Ω·cm) with a thickness of 3 to 100 μm, which is typically made of fluororubber having fluorine resin fine particles dispersed therein. Then, the layer is bonded by an adhesive (primer) of silane coupling agent series. The entire hardness of the first and second primary intermediate transfer drums 51 and 52 has elasticity of about 20 to 90° based on JIS-A hardness. Here, the important point resides in the resistance value and release properties of the surface. In a case where layers of high release properties each have a resistance value R of about $10^5$ to $10^9$ Ω, the material therefor is not particularly limited as far as the material has high release properties.

In this manner, the single-color or two-color toner images formed on the first and second primary intermediate transfer drums 51 and 52 are electrostatically subjected to tertiary transfer on the secondary intermediate transfer drum 53. Accordingly, a final toner image of a single color, two colors, three colors, or four colors of yellow (Y), magenta (M), black (K), and cyan (C) is formed on the secondary intermediate transfer drum 53.

In FIG. 5, on the first primary intermediate transfer drum 51, a magenta toner image is first transferred from the photosensitive drum 12 for magenta, and a yellow toner image is then transferred from the photosensitive drum 11 for yellow while overlapping the magenta toner image previously transferred. On the second primary intermediate transfer drum 52, a cyan toner image is first transferred from the photosensitive drum 14 for cyan, and a black toner image is then transferred from the photosensitive drum 13 for black while overlapping the cyan toner image previously transferred.

In an embodiment of the present invention shown in FIG. 5, the process distance varies in colors from the formation of the electrostatic latent image to the transfer of the full-color toner image on the paper. Accordingly, in the embodiment shown in FIG. 5, since the image-writing of the magenta image, the yellow image, the cyan image, and the black image is not performed in the stated order by the laser beams, the order of the toner images to be overlapped on the first and second primary intermediate transfer drums 51 and 52 is previously determined.

In this manner, as to the toner images formed on the first and second primary intermediate transfer drums 51 and 52, the yellow image and the magenta image are collectively transferred in this order from the first primary intermediate transfer drum 51 on the secondary intermediate transfer drum 53. After that, the black image and the cyan image are collectively transferred in this order from the second primary intermediate transfer drum 52 on the secondary intermediate transfer drum 53.

The surface potential required for the electrostatic transfer of the toner images from the first and second primary intermediate transfer drums 51 and 52 on the secondary intermediate transfer drum 53, is in the order of +600 to 1200 V. This surface potential is set to an optimal value depending on the charge condition of toner, ambient temperature, and humidity, similarly to the transfer of toner images from the photosensitive drums 11, 12, 13, and 14 on the first and second primary intermediate transfer drums 51 and 52. Since the potential difference between the first and second primary intermediate transfer drums 51 and 52, and the secondary intermediate transfer drum 53 is required for the transfer, it is necessary to set a value for the surface potential of the secondary intermediate transfer drum 53 in accordance with the surface potentials of the first and second primary intermediate transfer drums 51 and 52. As described above, in a case where the charge amount of toner is in the range from −30 to 50 μC/g under a normal temperature and a normal humidity, and the surface potentials of the first and second primary intermediate transfer drums 51 and 52 are about +400 V, the surface potential of the secondary intermediate transfer drum 53 is preferably set to about +800 V. In other words, it is preferable to set the potential difference between the first and second primary intermediate transfer drums 51 and 52, and the secondary intermediate transfer drum 53 to about +400 V.

The secondary intermediate transfer drum 53 used in this embodiment is formed to have the outer diameter of 60 mm, which is the same as those of the first and second primary intermediate transfer drums 51 and 52, and the resistance value thereof is set to about $10^{11}$ Ω, for example. Further, similar to the first and second primary intermediate transfer drums 51 and 52, the secondary intermediate transfer drum 53 is a cylindrical rotary member having elasticity in the surface, which is formed by a single layer or plural layers. In general, the transfer drum is formed by covering a metal pipe made of Fe, Al, etc., as a metal core, with a low resistance elastic rubber layer ($R=10^2$ to $10^3$ Ω), typically conductive silicone rubber layer or the like having a thickness of about 0.1 to 10 mm. Furthermore, the outmost surface of the secondary intermediate transfer drum 53 is formed as a layer of high release properties ($\rho v=10^{11}$ to $10^{13}$ Ω·cm) with a thickness of 3 to 100 μm, which is typically made of fluororubber having fluorine resin fine particles dispersed therein. Then, the layer is bonded by an adhesive (primer) of silane coupling agent series. Considering the entire hardness of the secondary intermediate transfer drum 53, the transfer drum has elasticity of about 20 to 90° based on JIS-A hardness. Here, it is necessary to set the resistance value of the secondary intermediate transfer drum 53 higher than those of the first and second primary intermediate transfer drums 51 and 52, otherwise the secondary intermediate transfer drum 53 charges the first and second primary intermediate transfer drums 51 and 52, causing difficulty in controlling the surface potentials of the first and second primary intermediate transfer drums 51 and 52. As far as the above-mentioned conditions are met, the material for the secondary intermediate transfer drum 53 is not particularly limited.

Next, by the final transfer roll 60 that is applied with the transfer voltage of about +2000 V, the final toner image of a single color, two colors, three colors, or four colors formed on the secondary intermediate transfer drum 53 is subjected to tertiary transfer on the paper P transported through the paper transport path. The paper P passes paper transport rolls 90 through a paper transport step (not-shown) to be sent into a nip part between the secondary intermediate transfer drum 53 and the final transfer roll 60. After the final transfer step, the final toner image formed on the paper is fixed by a fixing device 70, thereby completing a series of the image formation process.

The final transfer roll 60 as a transfer electric field imparting roll is a cylindrical rotary member having elasticity. This final transfer roll 60 is rotated by transmission of a driving force via a gear from the secondary intermediate transfer drum 53, or by driven movement due to a frictional drive force with the secondary intermediate transfer drum 53.

It should be noted here that after the transfer at the nip part between the secondary intermediate transfer drum 53 and the final transfer roll 60, residual toner is removed electrostatically or physically by a cleaner 62. The cleaner 62 is a conductive roll of a rotary cylinder shape having a resistance in which ρv is about $10^2$ to $10^3$ Ω·cm. A voltage of about +1200 V is imparted to the cleaner so that the residual toner is electrostatically absorbed and removed.

Similarly, the first and second primary intermediate transfer drums 51 and 52 are provided with cleaners 63 and 64, respectively, each of which imparted of a voltage of about +800 V. Residual toner remaining after the secondary transfer performed between the first and second primary intermediate transfer drums 51 and 52 and the secondary intermediate transfer drum 53, is removed by electrostatic and physical rotating frictional force. Similar to the cleaner 62, the components for the cleaners 63 and 64 are each a conductive roll in a rotary cylinder shape having a resistance in which ρv is about $10^2$ to $10^3$ Ω·cm.

Figure 6:
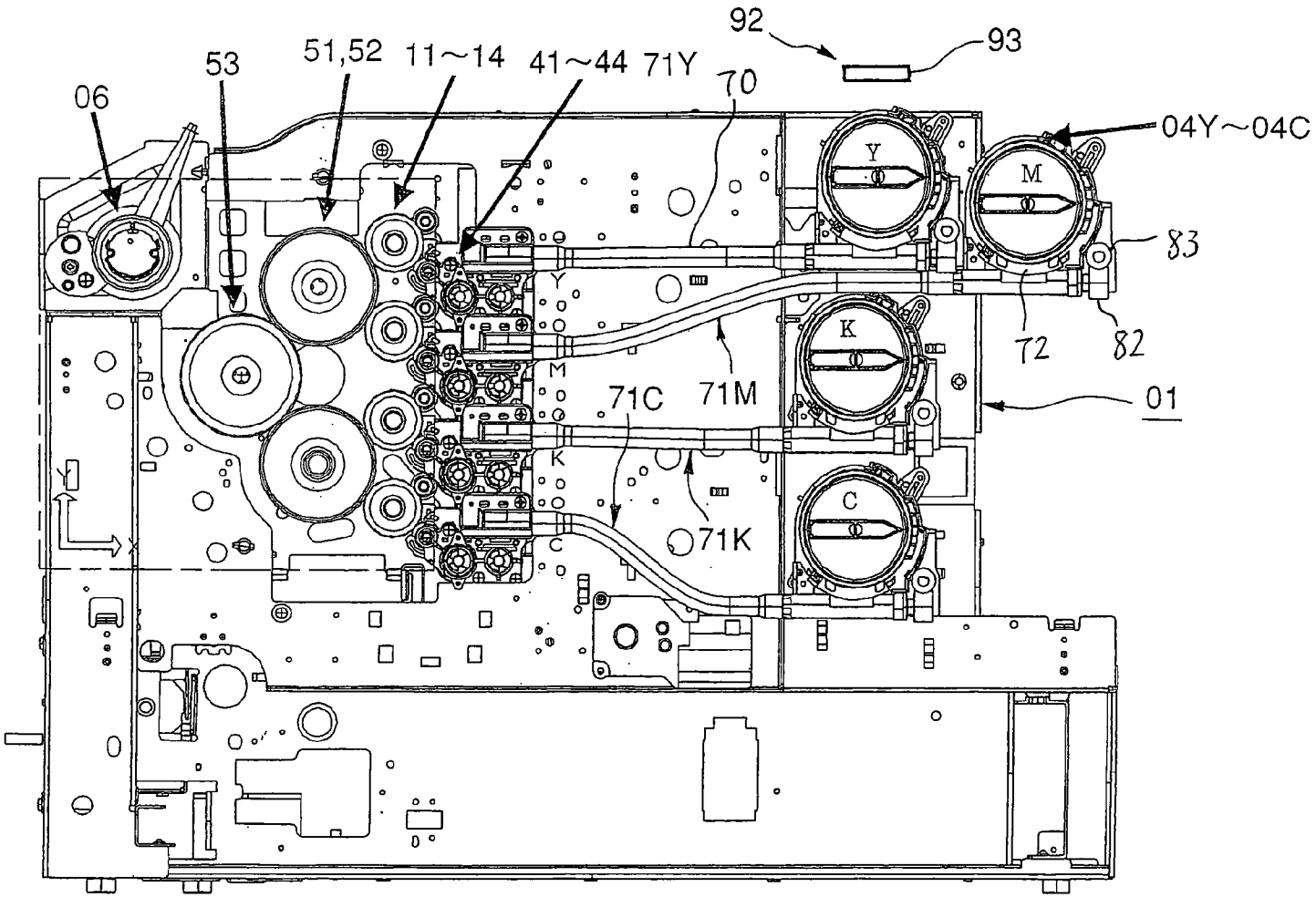
FIG. 6 is a structural view showing a developer supplying unit of the tandem-type full-color printer as the image forming apparatus according to Embodiment 1 of the present invention.
Figure 7:
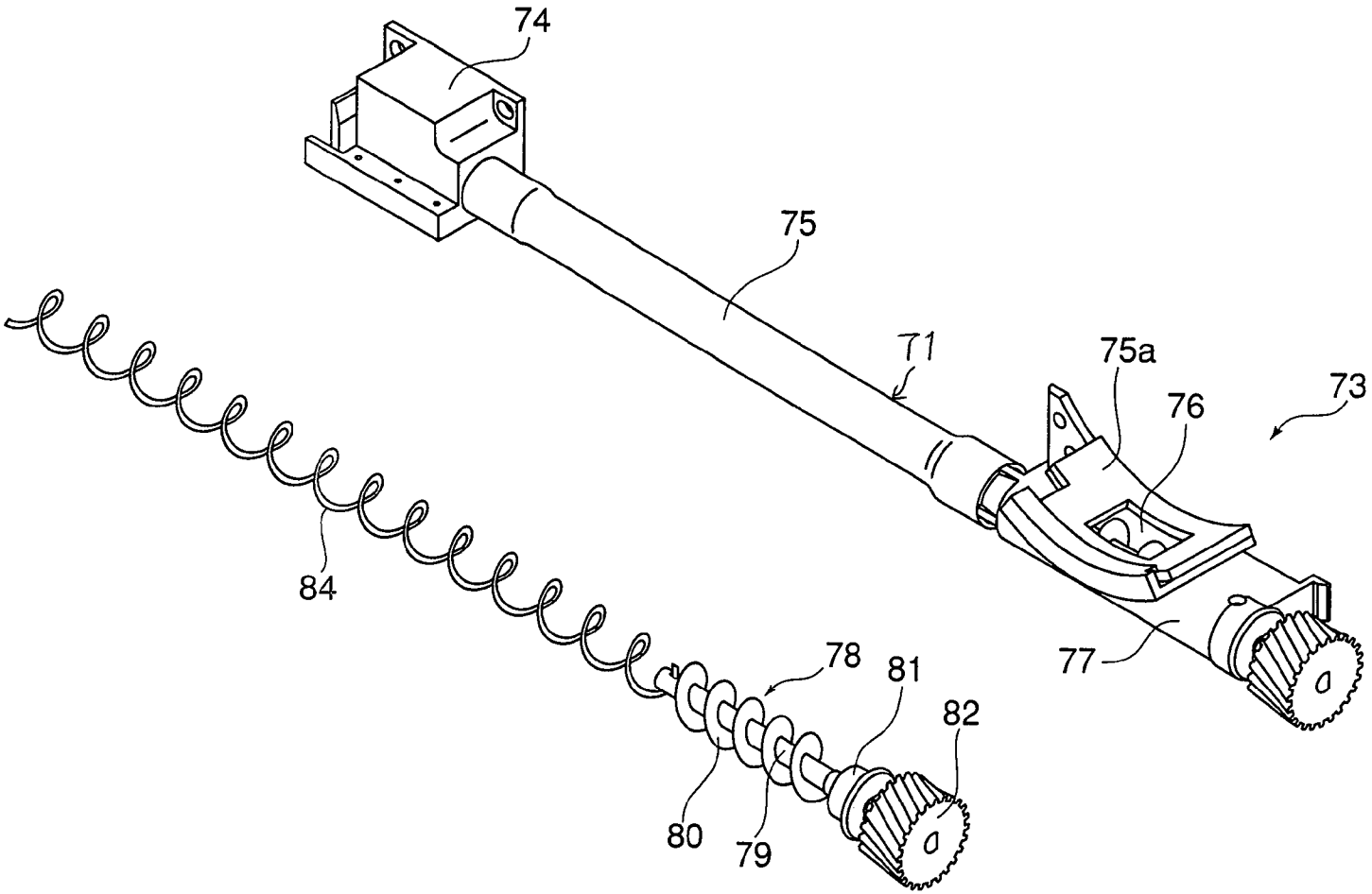
FIG. 7 is a structural view showing a developer feeding member of the tandem-type full-color printer as the image forming apparatus according to Embodiment 1 of the present invention.

FIG. 6 is an elevation structural diagram showing a main part of a tandem-type full-color printer having a developer supplying unit mounted thereto. FIG. 7 is a structural diagram showing the developer supplying unit.

As shown in FIG. 6, this developer supplying unit 70 is structured to include: the developer cartridge 04Y, 04M, 04K, 04C as a replacement part that receives a developer having toner of a predetermined color and carriers mixed therein; a developer feeding unit 71 that feeds toner or the like from the developer cartridge 04Y, 04M, 04K, 04C to the developing device 41, 42, 43, 44. Note that, as the developer, a case where the developer is composed of the mixture of toner and carriers is explained here, but the developer may of course be composed of only toner. The developer cartridge 04Y, 04M, 04K, 04C has a toner discharge port 72 opened in the vicinity of the lower edge of the cartridge on the front side. The toner discharge port 72 is usually closed by a shutter member (not-shown) and is structured so as to open in accordance with the movement of the developer cartridge 04Y, 04M, 04K, 04C upon mounting thereof to the printer main body 01. Note that, as shown in FIG. 6, the mounting of the developer cartridge 04Y, 04M, 04K, 04C is completed by inserting the developer cartridge 04Y, 04M, 04K, 04C to a predetermined position in the printer main body 01, while grabbing a handle provided on the end face in front of the developer cartridge 04Y, 04M, 04K, 04C and turning the handle clockwise by a predetermined angle. On the other hand, detachment of the developer cartridge 04Y, 04M, 04K, 04C from the printer main body 01 is performed by turning the handle counterclockwise by predetermined the angle and pulling the cartridge out to the user side.

As shown in FIG. 7, the developer feeding unit 71 includes: a joint member 73 to be jointed with the developer cartridge 04Y, 04M, 04K, 04C; a coupling member 74 to be coupled with the developing device 41, 42, 43, 44; and a pipe-like member 75 as a toner feeding path formation member that connects the joint member and the coupling member with each other. As shown in FIG. 7, the joint member 73 includes a joint part 75*a* having a curved surface of a circular arc shape to be jointed with the lower surface of the developer cartridge 04Y, 04M, 04K, 04C. The joint part 75*a* has an introduction port 76 that introduces the toner supplied by being dropped from the developing device 41, 42, 43, 44. Further, the joint member 73 is integrally provided with a toner feeding part 77 having a substantially cylindrical shape below the joint part 75*a*. Inside the toner feeding part 77, a feeding auger 78 is rotatably provided as a first feeding member that feeds the toner supplied by being dropped from the developer cartridge 04Y, 04M, 04K, 04C to the developing device 41, 42, 43, 44.

As shown in FIG. 7, the feeding auger 78 is composed of a toner feeding blade 80 formed into a helical shape at the outer periphery of a rotary shaft 79. The feeding auger 78 is attached to the base end of the toner feeding part 77 in a cantilever fashion by a bearing member 81 that rotatably supports the base end of the rotary shaft 79. Further, in the rotary shaft 79 of the feeding auger 78, a drive gear 82 constituting a tooth gear to rotate and drive the feeding auger 78 is attached to a base end 79*a* protruding to the outside of the toner feeding part 77. As shown in FIG. 6, the drive gear 82 is meshed with a drive force transmission gear 83 which is fixed at the end of the rotary shaft arranged along the side of the developer cartridge 04Y, 04M, 04K, 04C in the longitudinal direction thereof.

Furthermore, a cylindrical pipe-like member 75 made of a soft synthetic resin or the like having flexibility is attached to the leading end of the joint member 73 in an engagement state. Inside the pipe-like member 75 there is arranged a helical metal screw member 84 coupled with the leading end of the feeding auger 78. The toner supplied to the inside of the joint member 73 is fed by the screw member 84 to the coupling member 74 coupled with the developing device 41, 42, 43, 44. The coupling member 74 is attached to the leading end of the pipe-like member 75 in an engagement state so that the toner fed through the pipe-like member 75 is supplied by being dropped to the inside of the developing device 41, 42, 43, 44. As the screw member 84, for example, there is used one formed by twisting a linear metal member having a circular section into a helical shape.

As shown in FIG. 6, the developer supplying unit 70 is driven to rotate the drive force transmission gear 83 by a drive motor (not-shown) at a predetermined timing so that a predetermined color developer is supplied from the developer cartridge 04Y, 04M, 04K, 04C to the developer feeding unit 71. Then, the developer feeding unit 71 feeds the developer to the developing device 41, 42, 43, 44. Thus, a predetermined amount of the developer can be replenished in the developing device 41, 42, 43, 44. Note that, the replenishment amount of the developer from the developer cartridge 04Y, 04M, 04K, 04C is controlled by a drive time period of the drive motor driven to rotate the drive force transmission gear 83.

Incidentally, according to this embodiment, the image forming apparatus includes: at least one replacement part including a storage medium that can store information and in which identification information inherent to the replacement part is written; and an apparatus main body to which the replacement part is detachably mountable. The apparatus main body includes: a communication unit that serves to communicate the information with the storage medium of the replacement part; an information acquisition unit that acquires information on the replacement part from a storage unit provided to a component other than the replacement part based on the identification information obtained from the storage medium of the replacement part through the communication unit; and a management unit that manages a usage state of the replacement part in accordance with the information on the replacement part acquired by the information acquisition unit.

Figure 8:
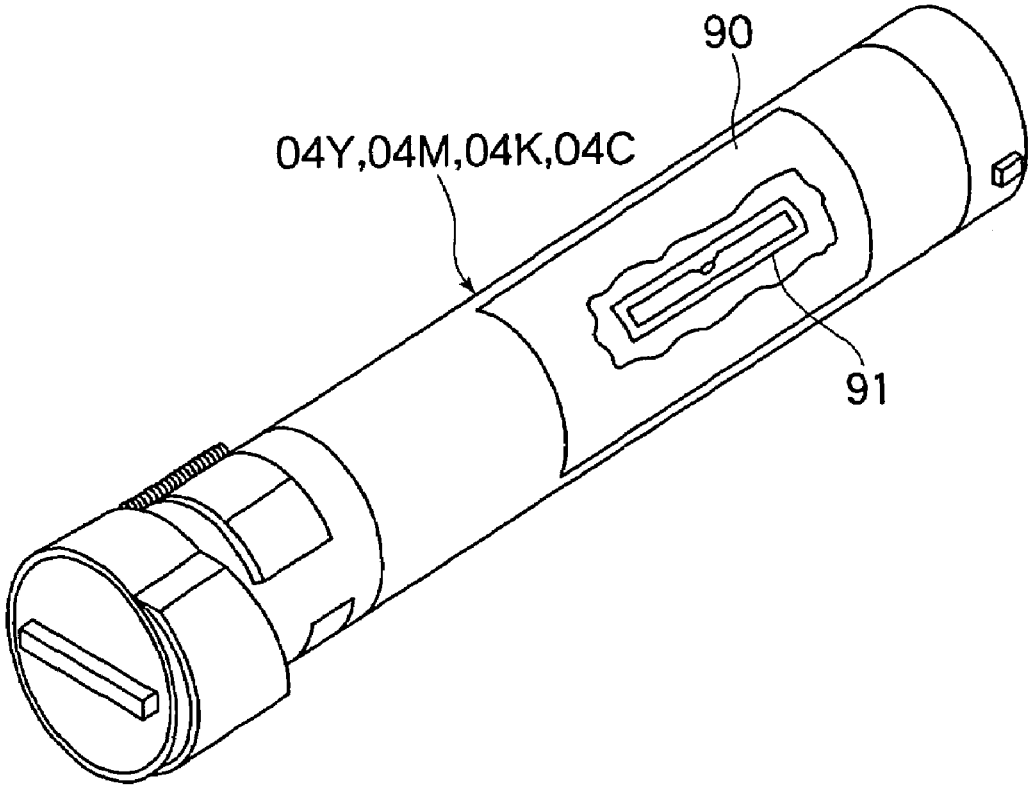
FIG. 8 is a perspective view showing an outer appearance of a developer cartridge.

That is, as shown in FIGS. 4 and 6, according to Embodiment 1, there are provided four developer cartridges 04Y, 04M, 04K, and 04C as the plural replacement parts. As shown in FIG. 8, in the developer cartridge 04Y, 04M, 04K, 04C, a label on which a toner color of the developer cartridge 04Y, 04M, 04K, 04C, a mounting method, etc. are written, is pasted on the outer peripheral surface of a cylindrical long receiving case 85. On the underside of the label 90 there is integrally pasted a storage element member 91, which is so-called "non-contact CROM", as a storage medium that stores identification information inherent to the developer cartridge 04Y, 04M, 04K, 04C. Further, inside the apparatus main body of the above-mentioned full-color printer, as shown in FIG. 6, at a position corresponding to the upper part on the back side of the developer cartridge 04Y, 04M, 04K, 04C, a communication unit 92 on the apparatus main body side is provided. The communication unit 92 serves to communicate with the storage element member 91 of the developer cartridge 04Y, 04M, 04K, 04C, through radio waves. The communication unit 92 on the apparatus main body side is provided with an antenna 93 that transmits and receives radio waves. Note that, a single antenna 93 of the communication unit 92 may communicate with four storage element members 91 of the developer cartridges 04Y, 04M, 04K, and 04C. Also, the four developer cartridges 04Y, 04M, 04K, and 04C may correspondingly be provided with four antennas 93 in total so that the four antennas 93 communicate with the developer cartridges 04Y, 04M, 04K, and 04C, respectively.

Figure 9:
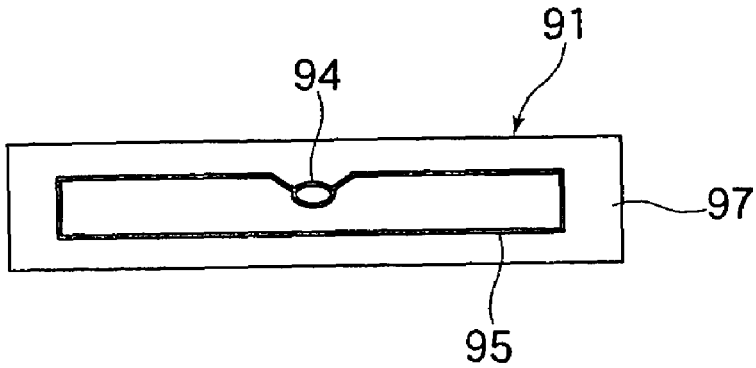
FIG. 9 is a plan view showing a storage element medium.

On the other hand, as shown in FIG. 9, the storage element members 91 provided to the developer cartridge 04Y, 04M, 04K, 04C has an extremely small rectangular storage element 94 arranged in the center. On both sides of the storage element 94 there are arranged transmitting/receiving antennas 95 in parallel with a small gap therebetween. To complete the storage element members 91, for example, the transmitting/receiving antennas 95 are patterned on a transparent film 97 made of a synthetic resin, and in a state where the storage element 94 is connected to the transmitting/receiving antennas 95, the storage element member 91 is covered by another transparent film 97 made of a synthetic resin. Note that, as the storage element members 91, for instance, 'μ-chip' that is an IC chip having a size of 0.4×0.4 mm manufactured by Hitachi, Ltd., an IC card, etc. can be employed.

The communication unit 92 on the apparatus main body side and the storage element member 91 on the developer cartridge 04Y, 04M, 04K, 04C side can communicate with each other through radio waves having a predetermined frequency. The communication unit 92 on the apparatus main body side can at least read out information on the developer cartridge 04Y, 04M, 04K, 04C, or the like, which is stored in the storage element 94 of the storage element member 91 on the developer cartridge 04Y, 04M, 04K, 04C side, through radio waves having a predetermined frequency. If needed, the communication unit 92 can perform reading and writing. Then, the communication unit 92 on the apparatus main body side transmits and receives the radio waves having a predetermined frequency to and from the antennas 93 and performs the transmission of the information with the storage element member 91 on the developer cartridge 04Y, 04M, 04K, 04C side in a non-contact state.

As the radio waves having a predetermined frequency used for the communication in the communication unit 92 on the apparatus main body side, for example, there are used radio waves having a frequency of 13.56 MHz. The distance in which the communication unit 92 on the apparatus main body side can perform the communication depends on the intensity of the radio waves and is about 2 to 4 cm in a case of weak radio waves, and about 25 cm in a case of low power radio waves. Here, in a case where the weak radio waves are employed such that the distance in which the communication unit 92 on the apparatus main body side can perform the communication may be about 2 to 4 cm, the information communication is performed by arranging the antennas 93 of the communication unit 92 on the apparatus main body side corresponding to the developer cartridge 04Y, 04M, 04K, 04C. Meanwhile, in a case where the low power radio waves are employed such that the distance in which the communication unit 92 on the apparatus main body side can perform the communication may be about 25 cm, as shown in FIG. 6, only the single antenna 93 of the communication unit 92 on the apparatus main body side is arranged corresponding to the developer cartridge 04Y, 04M, 04K, 04C, whereby the communication is enabled with the communication unit 92 on the apparatus main body side. Note that, the radio waves used in the communication with the communication unit 92 on the apparatus main body side may have the frequency of about 125 KHz, for example.

Figure 10:
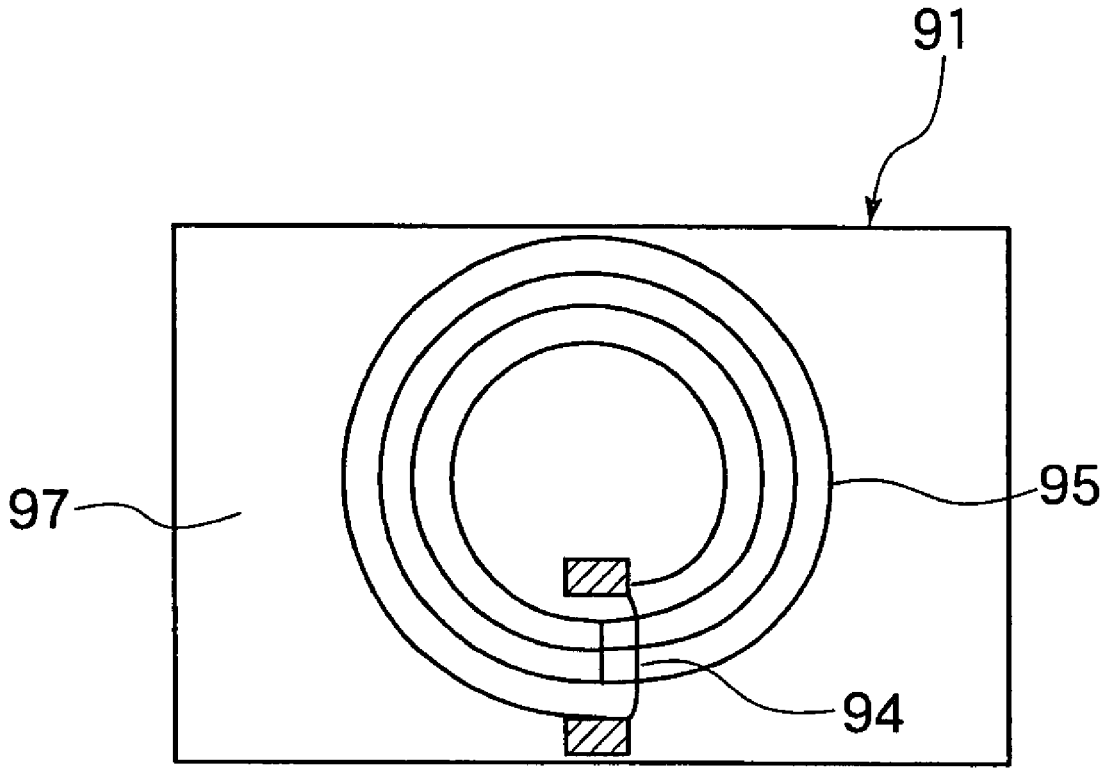
FIG. 10 is a plan view showing another storage element medium.

It should be noted here that as the storage element member 91 on the developer cartridge 04Y, 04M, 04K, 04C side, there may be used one shown in FIG. 10.

The above-mentioned storage element member 91 on the developer cartridge 04Y, 04M, 04K, 04C side does not have, for instance, its own power supply. The storage element member 91 is structured to obtain electric power used for reading information stored in the storage element 94 and electric power used for transmitting the information stored in the storage element 94 to the communication unit 92 on the apparatus main body side, by use of an electromagnetic induction effect generated upon reception of the radio waves transmitted from the communication unit 92 on the apparatus main body side by the receiving antenna 95.

Also, in this embodiment, identification information inherent to a replacement part is written in a storage medium mounted in the replacement part. The identification information is set different for each replacement part having the storage medium mounted therein.

Further, in this embodiment, the identification information is made of a consecutive number imparted every predetermined step, and also, the identification information written into the storage medium cannot be rewritten.

That is, in this embodiment, the storage element 94 stores only a number with given digits, e.g., 0000000001, 0000000002, 0000000003, . . . , as shown in FIG. 11, as inherent identification information (ID) used for identification of the developer cartridge 04Y, 04M, 04K, 04C. Therefore, storage capacity of the storage element 94 may be extremely small. The identification information made of a number with given digits is set different for each developer cartridge 04Y, 04M, 04K, 04C, having the storage element 94 mounted therein. As described above, the identification information is a consecutive number imparted every predetermined step, and the identification information written into the storage element 94 can only be read and cannot be rewritten.

Figure 12:
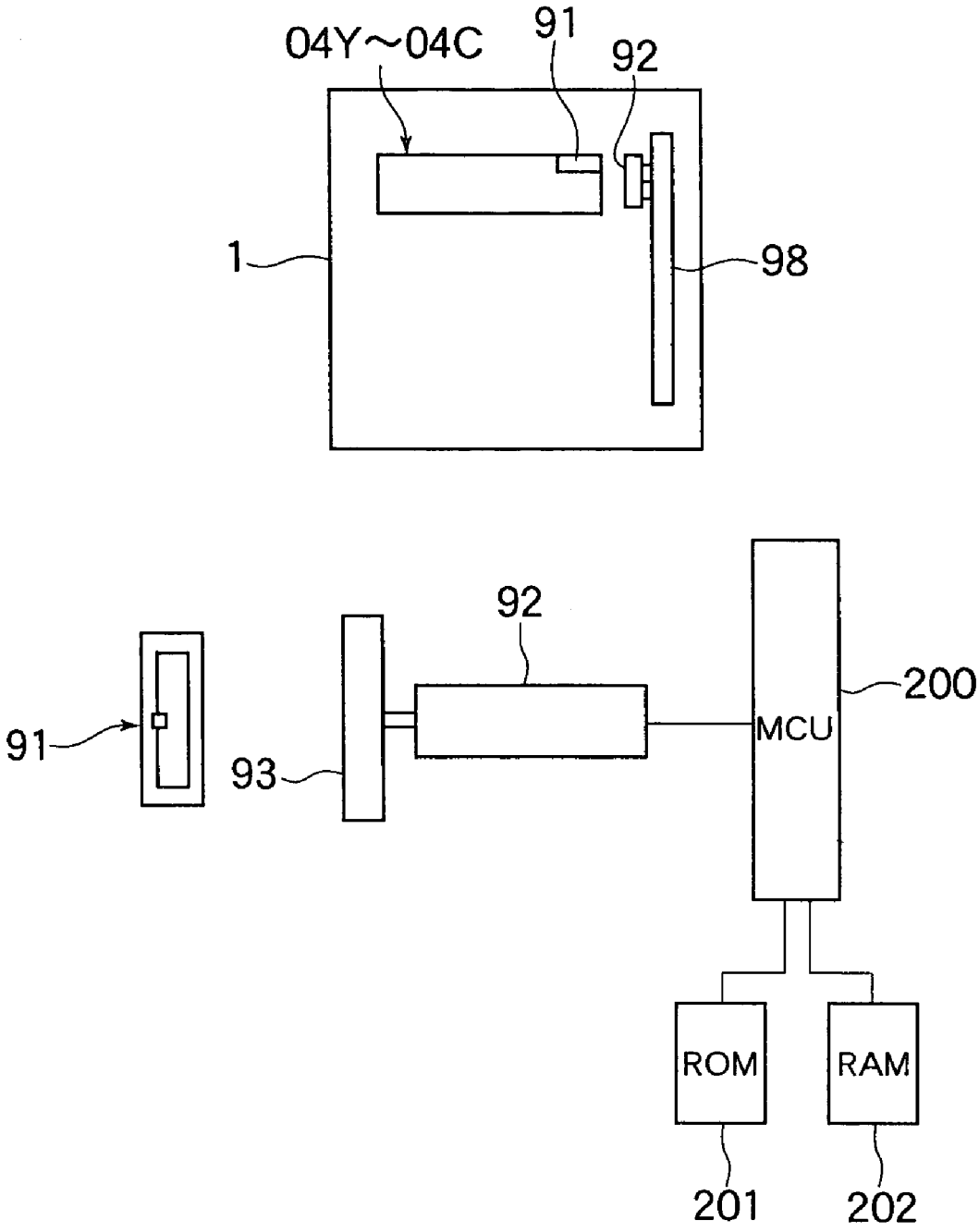
FIG. 12 is a structural view including a block diagram showing a control part of the tandem-type full-color printer as the image forming apparatus according to Embodiment 1 of the present invention.

Also, in this embodiment, as shown in FIG. 12, the communication unit 92 on the apparatus main body 01 side is integrally provided to an existing circuit board 98 arranged on the rear side of the apparatus main body 01.

Figure 13:
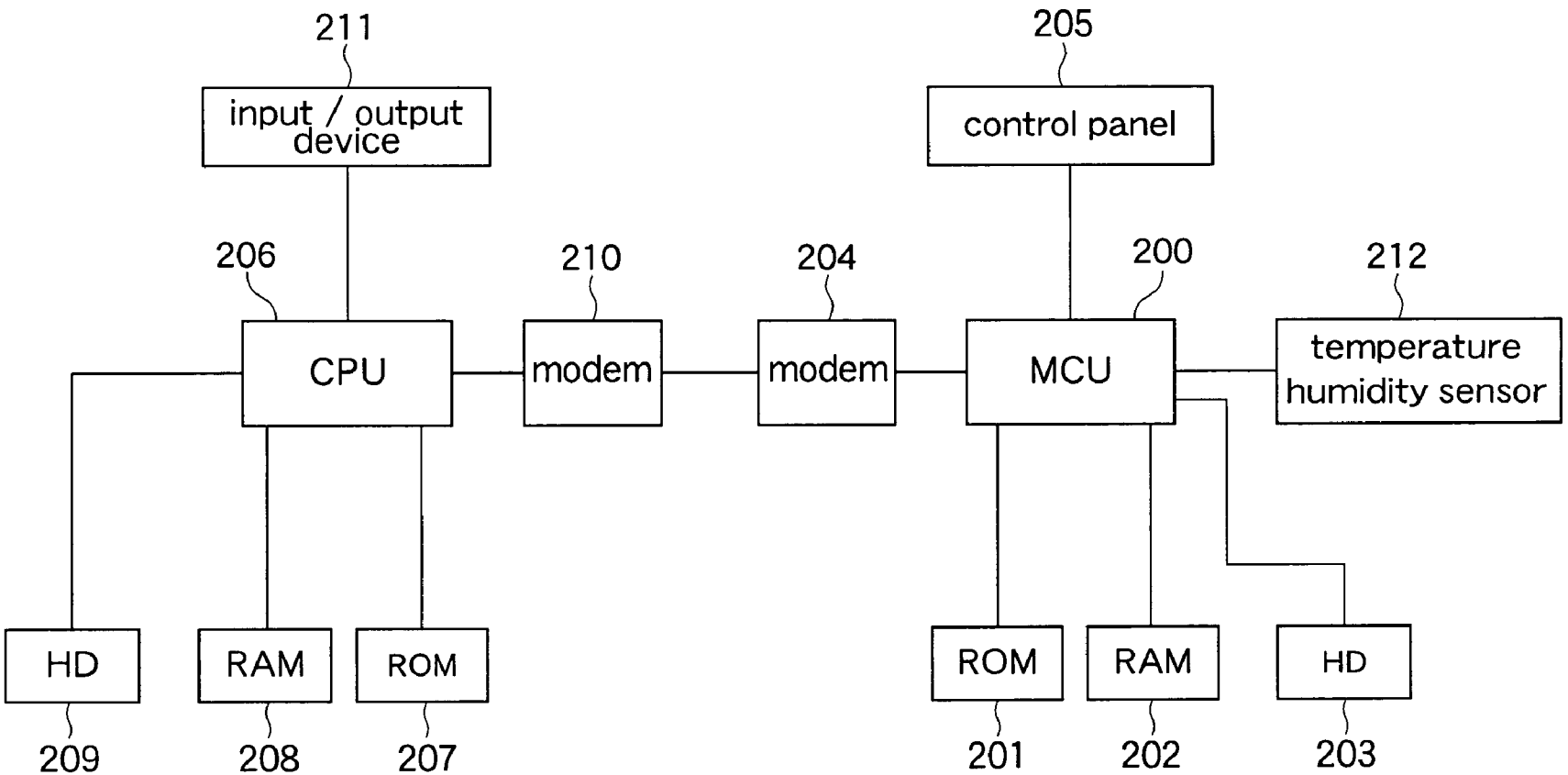
FIG. 13 is a block diagram showing the control part of the tandem-type full-color printer as the image forming apparatus according to Embodiment 1 of the present invention.

FIG. 13 is a block diagram showing a control circuit of the above-mentioned full-color printer.

In FIG. 13, an MCU 200 serves as control means which controls operation of the full-color printer 100 as an image forming apparatus (the MCU doubling as information acquisition means and management means). A ROM 201 stores a program for image formation and a program for management of replacement parts to be executed by the MCU 200. A RAM 202 stores parameters used for control performed in the MCU 200. A hard disk 203 stores information on image data, a usage state for management of replacement parts, and the like. A communication modem 204 is adopted to allow communication of the MCU 200 with other devices. A control panel 205 performs input and display of print conditions, etc in the full-color printer 100. A CPU 206 for the server 130 used by a user performs control of transmission/reception of data such as image data, and control of the full-color printer 100 as an image forming apparatus. A ROM 207 stores a program to be executed by the CPU 206. A RAM 208 stores parameters to be executed by the CPU 206. A hard disk 209 stores information on image data, a usage state for management of replacement parts, and the like. A communication modem 210 is adopted to allow communication of the server 130 with other devices. An input/output device 211 is used for a keyboard, display device, and the like of the server 130. And a temperature and relative humidity sensor 212 is arranged inside the printer main body 01, as shown in FIG. 4.

With the above structure, in a case of the image forming apparatus according to Embodiment 1, in the following manner, minimum necessary information is stored in the recording medium provided in the replacement part, thereby eliminating the necessity of using a large capacity memory; there can be prevented increase in costs and loading such as data write period or data read period; and a large amount of information concerning a kind of a replacement part, color identification of toner or the like, identification of device models, life counter, etc. can be used for control or the like of the image forming apparatus.

That is, in the tandem-type full-color printer according to Embodiment 1, as shown in FIGS. 4 and 5, the toner images of the respective colors of yellow, magenta, black and cyan are formed on the photosensitive drums 11, 12, 13, and 14 of the printer head 02 corresponding to image data. The toner images of the respective colors of yellow, magenta, black and cyan formed on the photosensitive drums 11, 12, 13, and 14 are transferred to the transfer paper P via the first and second primary intermediate transfer drums 51 and 52 and the secondary intermediate transfer drum 53. After that, the toner images are fixed by application heat and pressure by the fixing device 06, thereby forming a color or monochrome image.

Then, in the above-mentioned full-color printer, along with the color or monochrome image formation, the toner in the developer is consumed by the developing device 41, 42, 43, 44. The developer is supplied as needed from the developer cartridge 04Y, 04M, 04K, 04C to the developing device 41, 42, 43, 44. As shown in FIG. 2, as to the developer cartridge 04Y, 04M, 04K, 04C, by opening the front cover 101 of the printer main body 01 to the user side, the consumed developer cartridge 04Y, 04M, 04K, 04C mounted to a predetermined position in the printer main body 01 is detached, and there after a new developer cartridge 04Y, 04M, 04K, 04C is mounted to the predetermined position in the printer main body 01, as shown in FIG. 6.

As shown in FIG. 12, at this time, the MCU 200 of the printer main body 01 communicates with the storage medium 94 of the developer cartridge 04Y, 04M, 04K, 04C mounted to the printer main body 01 to detect which cartridge among the developer cartridges 04Y, 04M, 04K and 04C is replaced, and reads the identification information stored in the storage element medium 94 of the developer cartridges 04Y, 04M, 04K and 04C of interest via the communication means 92 step 101. As shown in FIG. 11, the identification information stored in the storage element medium 91 is each composed of a number with given digits being set to be different among all the replacement parts, for instance. As a result, the MCU 200 of the printer main body 01 reads the identification information stored in the storage element medium 94 of the developer cartridge 04Y, 04M, 04K, 04C via the communication means 92, thereby making it possible to recognize which developer cartridge as a replacement part among the developer cartridges 04Y, 04M, 04K, and 04C is replaced.

Figure 14:
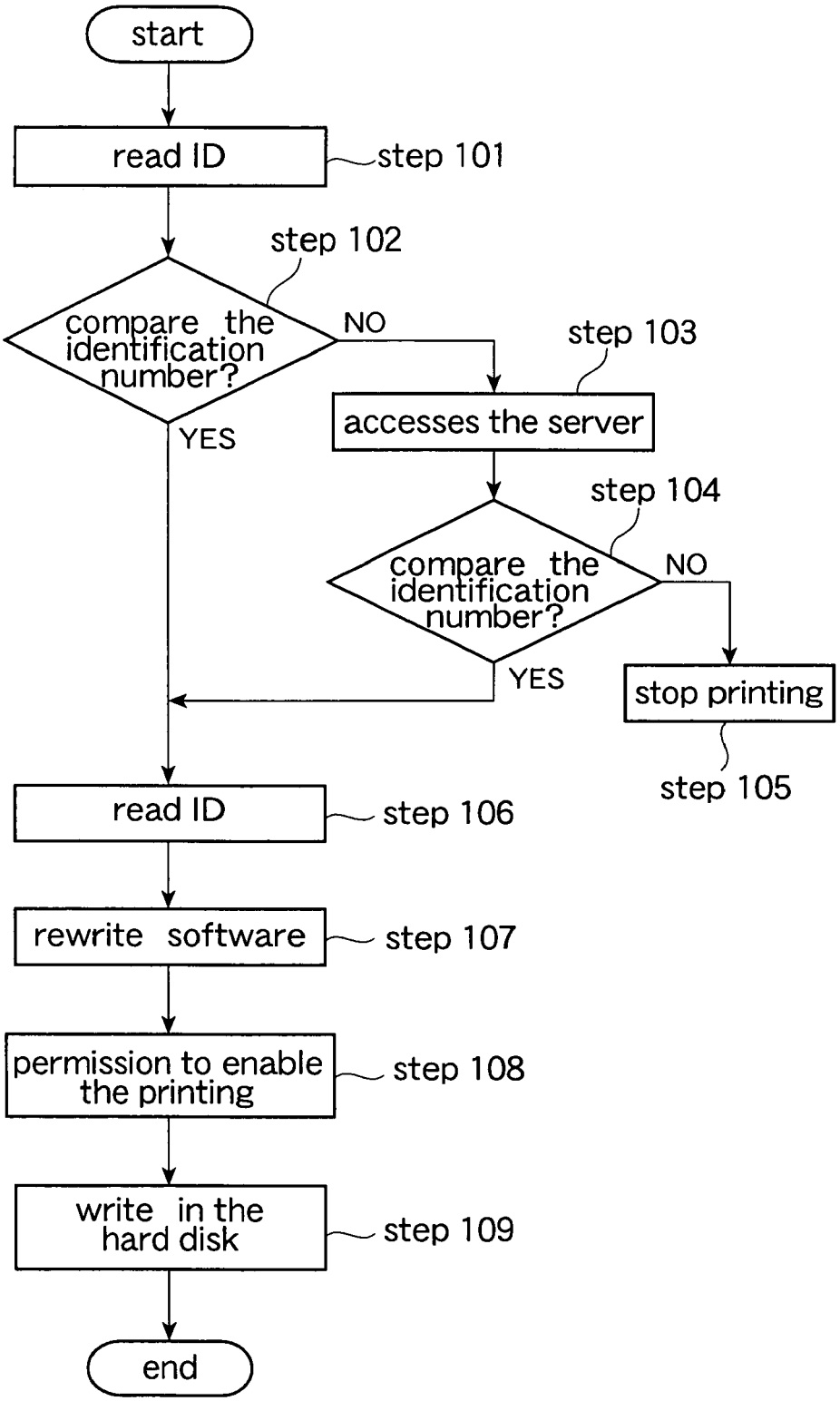
FIG. 14 is a flowchart showing operation of the tandem-type full-color printer as the image forming apparatus according to Embodiment 1 of the present invention.

Next, as shown in FIG. 14, the MCU 200 of the printer main body 01 compares the identification number in the read identification information of the developer cartridge 04Y, 04M, 04K, 04C with an identification number of the developer cartridge 04Y, 04M, 04K, 04C stored in the hard disk 203 in the apparatus main body 01 (step 102). Then, the MCU 200 of the printer main body 01 accesses the server 130 via the communication modem 204 in a case where the read identification information of the developer cartridge 04Y, 04M, 04K, 04C is not identical with the identification number of the developer cartridge 04Y, 04M, 04K, 04C stored in the hard disk 203 in the apparatus main body 01 (step 103).

The CPU 206 of the server 130 compares the identification number in the identification information of the developer cartridge 04Y, 04M, 04K, 04C sent from the MCU 200 of the printer main body 01 with an identification number of the developer cartridge 04Y, 04M, 04K, 04C stored in the hard disk 209 of the server 130 (step 104). Then, in a case where the read identification information of the developer cartridge 04Y, 04M, 04K, 04C is not identical with the identification number of the developer cartridge 04Y, 04M, 04K, 04C stored in the hard disk 209 of the server 130, the CPU 206 of the server 130 sends a control signal instructing to stop printing to the MCU 200 of the printer main body 01, thereby stopping the printing operation of the printer main body 01 (step 105).

On the other hand, in a case where the read identification information of the developer cartridge 04Y, 04M, 04K, 04C is identical with the identification number of the developer cartridge 04Y, 04M, 04K, 04C stored in the hard disk 203 in the apparatus main body 01, or in a case where the read identification information of the developer cartridge 04Y, 04M, 04K, 04C is identical with the identification number of the developer cartridge 04Y, 04M, 04K, 04C stored in the hard disk 209 of the server 130, the CPU 200 of the printer main body 01 reads information concerning a usage state of the developer cartridge 04Y, 04M, 04K, 04C from the hard disk 203 of the printer main body 01 based on the identification information of the developer cartridge 04Y, 04M, 04K, 04C (step 106).

At this time, the printing operation may of course be stopped immediately if the read identification information of the developer cartridge 04Y, 04M, 04K, 04C is not identical with the identification number of the developer cartridge 04Y, 04M, 04K, 04C stored in the hard disk 203 of the printer main body 01. However, in this embodiment, the printing operation is not stopped immediately, and it is further determined whether or not the read identification information of the developer cartridge 04Y, 04M, 04K, 04C is identical with the identification number of the developer cartridge 04Y, 04M, 04K, 04C stored in the hard disk 209 of the server 130. This is conducted to enable the printing operation even in the case described below. The toner or the like of the developer cartridge 04Y, 04M, 04K, 04C is changed as needed by a manufacturer into a new model for achieving improvement in image quality, etc., and the identification number of the developer cartridge 04Y, 04M, 04K, 04C is updated to have a new number. In some cases, the updated new identification information is not stored in the hard disk 203 of the printer main body 01 but stored in the hard disk 209 of the server 130.

In this case, the updated new identification information of a replacement part is not necessarily stored in the hard disk 203 of the printer main body 01 and thus, the storage capacity of the hard disk 203 is not redundantly increased. Also, the identification information itself of the replacement part does not necessarily be stored in the hard disk 203 of the printer main body 01, but may merely be stored in the hard disk 209 of the server 130.

In the hard disk 203 of the printer main body 01, there is stored information concerning a usage state of the developer cartridge 04Y, 04M, 04K, 04C as a replacement part corresponding to the identification information. As shown in FIG. 15, the information concerning the usage state of the developer cartridge 04Y, 04M, 04K, 04C includes, for example, a kind of a replacement part, color identification of toner or the like, identification of device models, life counter, identification between a new part and a recycled part, and the number of recycled times if the part is a recycled product. As to the information concerning the usage state of the developer cartridge 04Y, 04M, 04K, 04C stored in the hard disk 203, the value of the life counter is updated by the MCU 200 every time the developer is supplied from the developer cartridge 04Y, 04M, 04K, 04C.

After that, as shown in FIG. 14, the MCU 200 of the printer main body 01 rewrites software in the apparatus as needed (step 107), gives a permission to enable the printing operation by the printer 100, and executes the printing operation under the specified condition (step 108). At this time, if the supply of the developer is performed by one of the developer cartridges 04Y, 04M, 04K, and 04C, the MCU 200 updates the value of the life counter of the corresponding one of developer cartridges 04Y, 04M, 04K, and 04C in accordance with the replenish amount of the developer.

Then, after the completion of the printing operation, the MCU 200 of the printer main body 01 writes in the hard disk 203 operation information of the image forming apparatus concerning the number of prints during the use of the developer cartridge 04Y, 04M, 04K, 04C, selection between color mode and monochrome mode, use time period, the number of rotations of the photosensitive drum, temperature and humidity as the use environment, the number of paper jam occurrence, a trouble occurrence condition if a trouble other than paper jam occurs, etc., and then finishes the operation (step 109). Note that, the operation information on the number of prints and selection between color mode and monochrome mode may only be stored in the hard disk 209 of the server 130 and not stored in the hard disk 203 of the main printer body 01, or may be stored in both the hard disks.

In this way, in this embodiment, only inherent identification information (ID) needs to be stored in the storage medium element 91 of the developer cartridge 04Y, 04M, 04K, 04C. It is unnecessary to store in the storage medium element 91 of the developer cartridge 04Y, 04M, 04K, 04C a large amount of information concerning a kind of the developer cartridge 04Y, 04M, 04K, 04C, color identification of toner or the like, identification of device models, life counter, etc. Therefore, it is unnecessary to use a large capacity memory, and there can be prevented increase in costs and in loading such as data write period or data read period. Furthermore, by storing information of the developer cartridge 04Y, 04M, 04K, 04C concerning a kind of a developer cartridge 04Y, 04M, 04K, 04C, color identification of toner or the like, identification of device models, life counter, etc., in the hard disk 203 of the printer main body 01 installed on a component other than the developer cartridge 04Y, 04M, 04K, 04C, a large amount of information concerning the kind of the developer cartridge 04Y, 04M, 04K, 04C, color identification of toner or the like, identification of device models, life counter, etc. is retained to be used for control of the printer or the like, thereby performing appropriate control and improving operability.

Further, in Embodiment 1, the identification information is different in all the developer cartridges 04Y, 04M, 04K, and 04C having the storage medium element 91 mounted therein. Thus, the identification among the developer cartridges 04Y, 04M, 04K, and 04C can reliably be performed, and data can be managed for certain.

Furthermore, in Embodiment 1, the identification information written in the storage medium element 91 of the developer cartridge 04Y, 04M, 04K, 04C cannot be rewritten. Thus, in a case where a non-genuine developer cartridge is mounted to the apparatus main body 01, this is detected and the printing operation is stopped, thereby preventing the occurrence of image failure and apparatus breakage.

Embodiment 2

Figure 16:
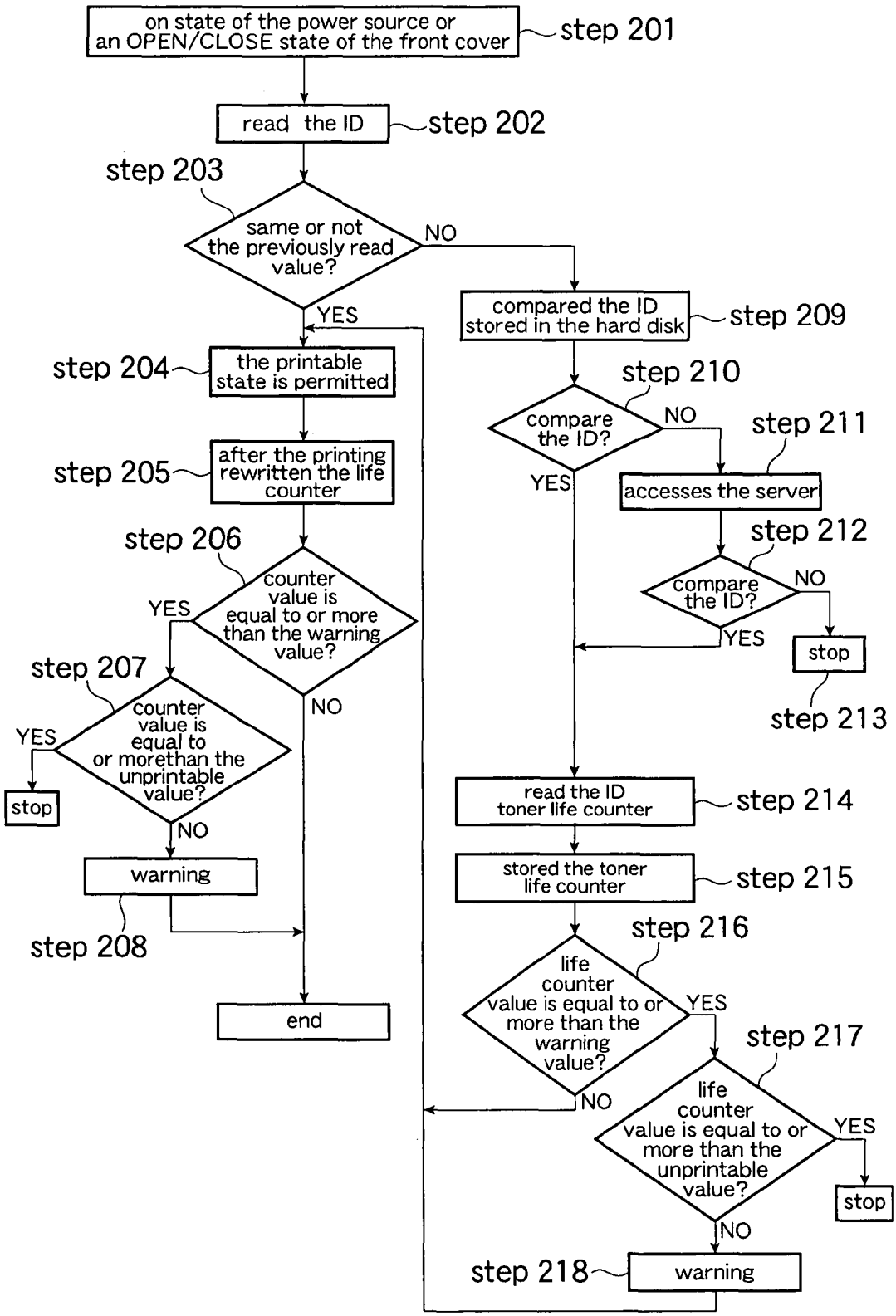
FIG. 16 is a flowchart showing operation of a tandem-type full-color printer as an image forming apparatus according to Embodiment 2 of the present invention.

FIG. 16 shows Embodiment 2 of the present invention, and the same elements as those of Embodiment 1 are denoted by the same symbols. The image forming apparatus according to Embodiment 2 is structured to have a control unit that, in a case where the replacement part is detached from the apparatus main body during usage thereof and mounted to the apparatus main body again, reads usage history information of the replacement part up to previous usage thereof from one of the storage unit of the apparatus main body and a storage unit of a server, and controls the usage history information to affect control of the image forming apparatus.

More specifically, according to Embodiment 2, as shown in FIG. 16, when an on state of the power source of the printer 100 or an OPEN/CLOSE state of the front cover 101 is detected (step 201), as in Embodiment 1, the MCU 200 of the printer main body 01 reads the identification information that is written in the storage medium element 91 of the developer cartridge 04Y, 04M, 04K, 04C mounted to the printer main body 01 (step 202). Then, the MCU 200 of the printer main body 01 storing the identification information of the developer cartridge 04Y, 04M, 04K, 04C in the RAM 202 or the like discriminates whether or not the value in the identification information of the developer cartridge 04Y, 04M, 04K, 04C which has been read is the same as the previously read value (step 203). If the values are the same, the printable state is permitted (step 204), and after the printing, the life counter value of the developer cartridge 04Y, 04M, 04K, 04C is rewritten (step 205).

Next, the MCU 200 of the printer main body 01 discriminates whether or not the life counter value of the developer cartridge 04Y, 04M, 04K, 04C is equal to or more than the warning value by which to indicate a warning of a predetermined amount left before running out of the developer (step 206). If the life counter value is less than the warning value, the MCU 200 ends the operation. Alternatively, if the life counter value is equal to or more than the warning value, the MCU 200 further discriminates whether or not the life counter value is equal to or more than the unprintable value (step 207). If the life counter value is less than the unprintable value, the developer cartridge 04Y, 04M, 04K, 04C will soon become empty, and therefore the indication is made of a warning that urges the user to order a new developer cartridge 04Y, 04M, 04K, 04C, or the like (step 208). If the life counter value is equal to or more than the unprintable value, the MCU 200 stops the printing operation.

On the other hand, the MCU 200 of the printer main body 01 judges in step 203 that the value in the identification information of the developer cartridge 04Y, 04M, 04K, 04C which has been read is not the same as the previously read value, the identification information is compared with that of the developer cartridge 04Y, 04M, 04K, 04C which is stored in the hard disk 203 inside the printer main body 01 (step 209). Then, in the case where the identification number in the identification information of the developer cartridge 04Y, 04M, 04K, 04C which has been read does not coincide with that of the developer cartridge 04Y, 04M, 04K, 04C which is stored in the hard disk 203, the MCU 200 of the printer main body 01 accesses the server 130 through the communication modem 204 (step 211).

The CPU 206 of the server 130 compares the identification number in the identification information of the developer cartridge 04Y, 04M, 04K, 04C which has been sent from the MCU 200 of the printer main body 01 with that of the developer cartridge 04Y, 04M, 04K, 04C which is stored in the hard disk 209 of the server 130 (step 212). Then, in the case where the identification number in the identification information of the developer cartridge 04Y, 04M, 04K, 04C which has been read does not coincide with that of the developer cartridge 04Y, 04M, 04K, 04C which is stored in the hard disk 209 of the server 130, the CPU 206 of the server 130 sends to the MCU 200 of the printer main body 01 a signal used for the control of stopping printing, and make the printing operation of the printer main body 01 to be stopped (step 213).

On the other hand, in the case where the identification number in the identification information of the developer cartridge 04Y, 04M, 04K, 04C which has been read coincides with that of the developer cartridge 04Y, 04M, 04K, 04C which is stored in the hard disk 203 inside the apparatus main body 01, or in the case where the identification number in the identification information of the developer cartridge 04Y, 04M, 04K, 04C which has been read coincides with that of the developer cartridge 04Y, 04M, 04K, 04C which is stored in the hard disk 209 of the server 130, the MCU 200 of the printer main body 01 reads the information on the usage state of the developer cartridge 04Y, 04M, 04K, 04C from the hard disk 209 of the printer main body 01 based on the identification information of the developer cartridge 04Y, 04M, 04K, 04C (step 214).

After that, in the case where a developer cartridge 04Y, 04M, 04K, 04C is detached from the printer main body 01 during the usage thereof and the same developer cartridge 04Y, 04M, 04K, 04C is then mounted to the printer main body 01 again to be used, the MCU 200 of the printer main body 01 rewrites the toner life counter value among the information on the usage state of the developer cartridge 04Y, 04M, 04K, 04C which has been read from the hard disk 209 of the printer main body 01 into a toner life counter value stored when previously used (step 215).

After that, the MCU 200 of the printer main body 01 discriminates whether or not the rewritten life counter value of the developer cartridge 04Y, 04M, 04K, 04C is equal to or more than the warning value (step 216). If the life counter value is less than the warning value, the process advances to step 204 to permit the printable state. Alternatively, if the life counter value is equal to or more than the warning value, the MCU 200 further discriminates whether or not the life counter value is equal to or more than the unprintable value (step 217). If the life counter value is less than the unprintable value, the developer cartridge 04Y, 04M, 04K, 04C will soon become empty, therefore the indication is made of a warning that urges the user to order a new developer cartridge 04Y, 04M, 04K, 04C, or the like (step 218), and then the process advances to step 204 to permit the printable state. If the life counter value is equal to or more than the unprintable value, the MCU 200 stops the printing operation.

Therefore, according to Embodiment 2, even in the case where the developer cartridge 04Y, 04M, 04K, 04C is detached from the printer main body 01 during the usage thereof and the same developer cartridge 04Y, 04M, 04K, 04C is then mounted to the printer main body 01 again to be used, the developer cartridge 04Y, 04M, 04K, 04C that is an authorized product can naturally be used continuously. Moreover, the life counter of the toner inside the developer cartridge 04Y, 04M, 04K, 04C can also be managed normally.

Note that the image forming apparatus according to Embodiment 2 may be structured to have a control unit that controls a life warning notification time when the replacement part reaches its life end to be changed into a predetermined time from the usage state of the replacement part.

Other structures and operations of Embodiment 2 are the same as those of Embodiment 1, so that its description will be omitted.

Embodiment 3

Figure 17:
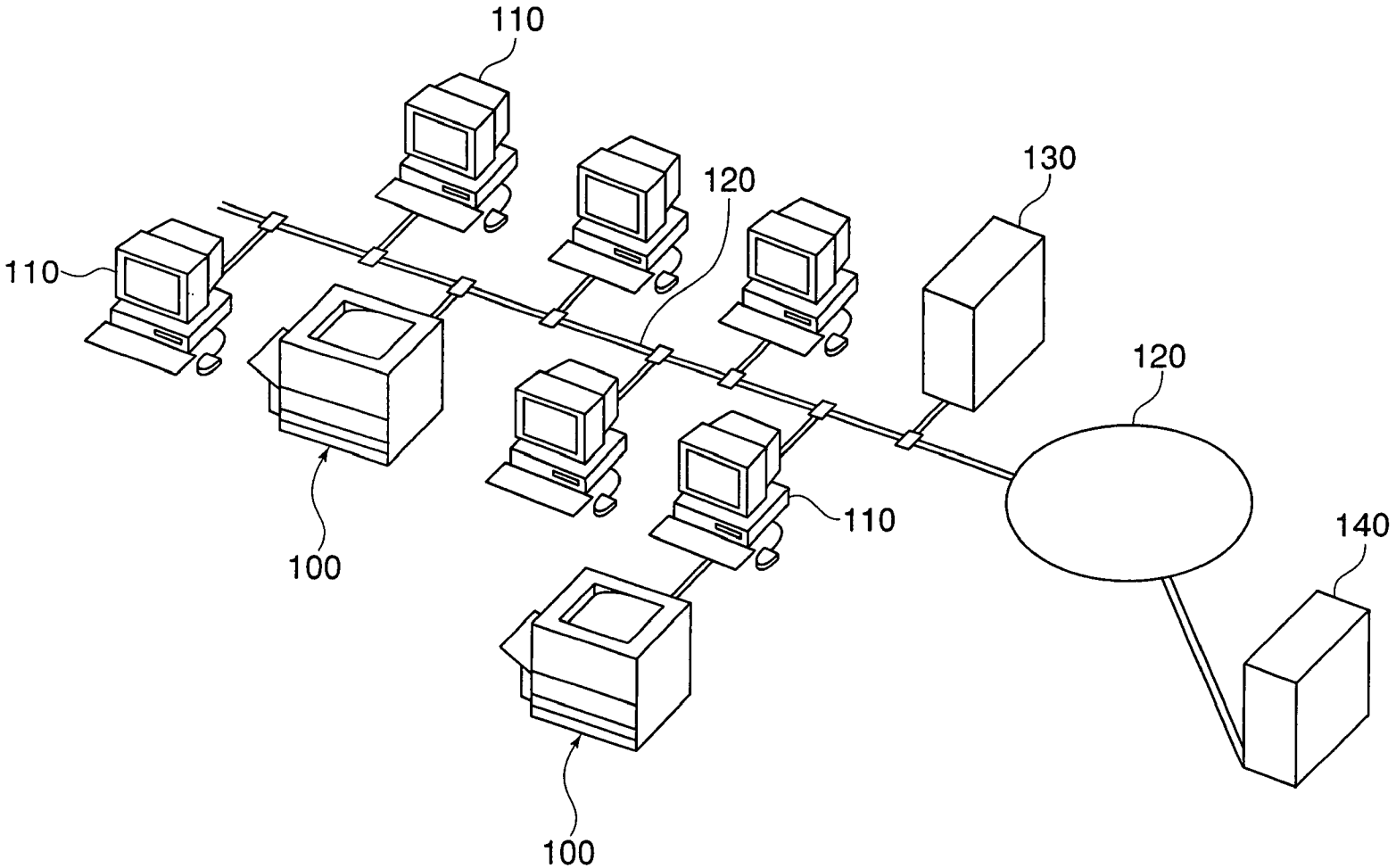
FIG. 17 is an explanatory view showing a usage state of tandem-type full-color printers as image forming apparatuses according to Embodiments 3 and 4 of the present invention.

FIG. 17 shows Embodiment 3 of the present invention, and the same elements as those of Embodiment 1 are denoted by the same symbols. The image forming apparatus according to Embodiment 3 is connected through a network to a management server managing the image forming apparatus so that data can be sent to and received from the management server, and is structured to have a control unit that obtains information on an operating state of the image forming apparatus, transmits the information on the operating state of the image forming apparatus through the network to the management server, and manages the operating state of the image forming apparatus based on the data sent from the management server.

Also, the image forming apparatus according to Embodiment 3 is structured to have a control unit that controls the operation of the image forming apparatus to be permitted only when inherent information corresponding to the identification information of the replacement part is inputted by a predetermined method.

Further, the image forming apparatus according to Embodiment 3 has a structure in which the inherent information corresponding to the identification information of the replacement part can be inputted from a personal computer connected to the image forming apparatus through the network.

Further, the image forming apparatus according to Embodiment 3 has a structure in which permission to use the image forming apparatus corresponding to the identification information of the replacement part can be selectively granted to the user connected to the network.

More specifically, according to Embodiment 3, as shown in FIG. 17, the full-color printers 100 are connected to the personal computers 110 and the server 130 for the user, or connected to a management server 140 owned by a manufacturer through the Internet that is connected through the network 120 or the like.

According to Embodiment 3, it is possible that the user inputs the inherent information which is inherent to the user and corresponds to the identification information of the replacement part, such as a staff member ID, to the full-color printer 100 from the personal computer 110 connected through the network 120, and the MCU 200 of the printer main body 01 discriminates the user's inherent information and selectively permit the printing operation in the full-color printer 100.

At that time, the MCU 200 of the printer main body 01 may conduct management so as to not only selectively permit the printing operation depending on the user's inherent information, but also to prohibit the printing in color and permit only the monochrome printing depending on the user's inherent information.

Other structures and operations of Embodiment 3 are the same as those of Embodiment 1, so that its description will be omitted.

Embodiment 4

FIG. 17 shows Embodiment 4 of the present invention, and the same elements as those of Embodiment 1 are denoted by the same symbols. Similarly to Embodiment 3, the image forming apparatus according to Embodiment 4 is connected through a network to a management server managing the image forming apparatus so that data can be sent to and received from the management server, and is assumed to have a structure including a control unit that obtains information on an operating state of the image forming apparatus, transmits the information on the operating state of the image forming apparatus through the network to the management server, and manages the operating state of the image forming apparatus based on the data sent from the management server.

Also, the image forming apparatus according to Embodiment 4 is structured to have a control unit that conducts control so that latest software for operating the image forming apparatus is installed through the network.

Further, the image forming apparatus according to Embodiment 4 is structured to have a control unit that, in a case where trouble occurs in the image forming apparatus, conducts control so that information thereof is transmitted to the manufacturer through the network.

Further, the image forming apparatus according to Embodiment 4 is structured to have a control unit that conducts control so that diagnostics is run on the image forming apparatus having the trouble.

Further, the image forming apparatus according to Embodiment 4 is structured to have a control unit that conducts control so that a notification of information for solving the trouble with the image forming apparatus is made to the user through the network.

Further, according to Embodiment 4, the server stores manufacture's change information on the replacement part, and the image forming apparatus is structured to have a control unit that, when the identification information of the replacement part is detected, conducts control so that a notification of the change information on the replacement part is made to the user.

Further, the image forming apparatus according to Embodiment 4 is structured to have a control unit that, when the image forming apparatus is changed into a new generation model by replacing at least one part with a new part, conducts control so that software corresponding to the new generation model is installed.

That is, in Embodiment 4, as described above, as shown in FIG. 17, the full-color printers 100 are connected via the network 120 to the personal computers 110, the user server 130, or the management server 140 on the manufacturer side. The full-color printers 100 perform data communications with the management server 140 on the manufacturer side, or the like. Thus, the full-color printers 100 can be operated based on a latest program, etc.

The MCU 200 of the printer main body 01 performs data communications with the management server 140 on the manufacturer side via the communication modem 204 at a predetermined timing, for example, when the power source of the printer main body 01 is turned on. If latest software is uploaded in the manufacturer management server 140, the latest software is automatically downloaded to overwrite the existing software for control. Thus, the control operation of printing or the like can be executed based on the latest software.

Further, in a case where a trouble occurs in the printer main body 01, the MCU 200 of the printer main body 01 analyzes itself to find out details of the trouble, and determines that the trouble can immediately be solved by the user, e.g., paper jam, the trouble can be recovered by the user following a predetermined manual, or the trouble requires a maintenance of a service engineer, e.g., a case where the image quality exceeds a predetermined control range. Then, according to the content of the trouble, via the network 120, the MCU 200 of the printer main body 01 informs the user interface of the printer main body 01, the user interface of the personal computer 110 connected to the printer main body 01, or the like, of information used for solving the trouble.

Furthermore, in a case where replacement of the replacement part is detected, for example, the MCU 200 of the printer main body 01 informs the manufacturer management server 140 of information on the replacement of the replacement part via the network 120. At this time, model change information on the of replacement part the manufacturer side is stored in advance in the manufacturer management server 140. After that, the MCU 200 of the printer main body 01 informs the user of the model change information on the replacement part upon the detection of the identification information of the replacement part.

Meanwhile, the model of the full-color printer 100 can be changed into a new generation by replacing at least one part by a new part in a case of employing a replacement part that can be replaced by the user as a matter of course, and also in a case of employing a replacement part that is replaced by a service engineer, etc. Up to now, in a case where the model of the full-color printer 100 is changed into a new generation by replacing at least one part of the full-color printer 100 by a new part as described above, the full-color printer 100 itself is replaced by a new generation model. Then, the used full-color printer 100 serves to be recycled as needed.

At this time, in a case where the full-color printer 100 is changed into a new generation by replacing at least one part of the full-color printer 100 by a new part, if the MCU 200 of the printer main body 01 installs software corresponding to the new generation model, the full-color printer 100 itself does not need to be replaced by a new generation model, and the printer can continuously be used.

Other structures and operations are the same as those in Embodiment 1, and description thereof is omitted.

What is claimed is:

1. An image forming apparatus comprising:

at least one replacement part including a storage medium that can store information and into which identification information inherent to the replacement part is written; and an apparatus main body to which the replacement part is detachably mountable and which includes:

a communication unit that serves to communicate the information with the storage medium of the replacement part;

an information acquisition unit that, based on the identification information obtained from the storage medium of the replacement part through the communication unit, acquires information on the replacement part from a storage unit provided to an element other than the replacement part; and a management unit that manages a usage state of the replacement part in accordance with the information on the replacement part acquired by the information acquisition unit.

2. An image forming apparatus according to claim 1, wherein the identification information is different for each replacement part including the storage medium.

3. An image forming apparatus according to claim 1, wherein the identification information is a consecutive number imparted to each predetermined step.

4. An image forming apparatus according to claim 1, wherein the identification information written into the storage medium cannot be rewritten.

5. An image forming apparatus according to claim 1, wherein the information on the replacement part corresponding to the identification information is stored in a storage unit provided to the apparatus main body.

6. An image forming apparatus according to claim 1, wherein:

the information on the replacement part corresponding to the identification information is stored in a storage unit provided to a server;

the server is connected to the image forming apparatus through a network so that data can be sent to and received from the image forming apparatus; and after the image forming apparatus acquires the identification information, the information acquisition unit acquires the information on the replacement part corresponding to the identification information from the storage unit provided to the server.

7. An image forming apparatus according to claim 1, further comprising an access unit that automatically accesses a server through a network in a case where identification information that is not stored in the storage unit of the apparatus main body is acquired.

8. An image forming apparatus according to claim 1, further comprising an update unit that periodically updates the information on the replacement part stored in the storage unit of the apparatus main body.

9. An image forming apparatus according to claim 1, further comprising a control unit that controls the apparatus not to operate in a case where the identification information of the replacement part mounted to the apparatus main body is compared with the identification information stored in one of the storage unit of the apparatus main body and a storage unit of a server with the result that the identification information of the replacement part mounted does not exist in the one of the storage unit of the apparatus main body and the storage unit of the server.

10. An image forming apparatus according to claim 1, wherein the apparatus main body further includes a control unit that controls the storage unit of the apparatus main body to store the information on the usage state of the replacement part.

11. An image forming apparatus according to claim 1, wherein:

the apparatus main body further includes a control unit that controls the information on the usage state of the replacement part to be transmitted to a server through a network; and the storage unit is included in the server and stores the information on the usage state of the replacement part.

12. An image forming apparatus according to claim 1, further comprising a control unit that, in a case where the replacement part is detached from the apparatus main body during usage thereof and mounted to the apparatus main body again, reads usage history information of the replacement part up to previous usage thereof is read from one of the storage unit of the apparatus main body and a storage unit of a server, and controls the usage history information to affect control of the image forming apparatus.

13. An image forming apparatus according to claim 1, further comprising a control unit that, in a case where the replacement part reaches a life end, controls information on an unusable state of the replacement part to be transmitted to one of a storage unit of the apparatus main body and a storage unit of a server.

14. An image forming apparatus according to claim 1, further comprising a control unit that controls the image forming apparatus not to operate in a case of acquiring the identification information of the replacement part that reaches a life end.

15. An image forming apparatus according to claim 1, further comprising a control unit that, in a case of acquiring the identification information of the replacement part that reaches a life end, controls one of a storage unit of the apparatus main body and a storage unit of a server to store a usage history information of the replacement part that reaches the life end.

16. An image forming apparatus according to claim 1, further comprising a control unit that, in a case of reconditioning the replacement part that reaches a life end, controls information on a usable state of the reconditioned replacement part to be transmitted to one of the storage unit of the apparatus main body and a storage unit of a server, and controls the one of the storage unit of the apparatus main body and the storage unit of the server to store a number of reconditionings.

17. An image forming apparatus which is connected through a network to a management server managing the image forming apparatus so that data can be sent to and received from the management server, the image forming apparatus comprising:

at least one replacement part including a storage medium, wherein the storage medium only stores identification information inherent to the replacement part; and an apparatus main body to which the replacement part is detachably mountable and which includes:

a control unit that obtains information on an operating state of the image forming apparatus, wherein the operating state includes information stored in a storage medium, transmits the information on the operating state of the image forming apparatus through the network to the management server, and manages the operating state of the image forming apparatus based on the data sent from the management servers, wherein the information includes usage state of the at least one replacement part.

18. An image forming apparatus according to claim 17, further comprising:

wherein the apparatus main body includes a communication unit that serves to communicate the information with the storage medium of the replacement part.

19. An image forming apparatus according to claim 17, further comprising a control unit that controls operational information of the image forming apparatus during usage of a replacement part, which includes a number of printed sheets, a usage environment, and a number of paper jams, to be stored in a storage unit provided to an apparatus main body, and to be transmitted to the management server upon replacing the replacement part.

20. An image forming apparatus according to claim 17, further comprising a control unit that controls operational information of the image forming apparatus during usage of the replacement part, which includes a number of printed sheets, a usage environment, a number of paper jams, and a trouble occurring state, to be continuously transmitted to the management server through the network.

21. An image forming apparatus according to claim 17, further comprising a control unit that controls an optimal operational condition of the image forming apparatus corresponding to identification information of a replacement part to be acquired through the network and to affect control of the image forming apparatus.

22. An image forming apparatus according to claim 17, further comprising a control unit that, when finishing using a replacement part, controls a notification of a receiver's address for sending the used replacement part to be made to a user based on identification information of the replacement part.

23. An image forming apparatus according to claim 17, further comprising a control unit that controls operation of the image forming apparatus to be permitted only when inherent information corresponding to identification information of a replacement part is inputted.

24. An image forming apparatus according to claim 17, further comprising inherent information corresponding to identification information of the replacement part which can be inputted from a personal computer connected to the image forming apparatus through the network.

25. An image forming apparatus according to claim 17, wherein permission to use the image forming apparatus corresponding to identification information of the replacement part can be selectively granted to a user connected to the network.

26. An image forming apparatus according to claim 17, further comprising a control unit that controls latest software for operating the image forming apparatus to be installed through the network.

27. An image forming apparatus according to claim 17, further comprising a control unit that, in a case where trouble occurs in the image forming apparatus, controls information thereof to be transmitted to a manufacturer through the network.

28. An image forming apparatus according to claim 17, further comprising a control unit that controls diagnostics to be run on the image forming apparatus having trouble through the network.

29. An image forming apparatus according to claim 17, further comprising a control unit that controls a notification of information for solving trouble with the image forming apparatus to be made to a user through the network.

30. An image forming apparatus according to claim 17, wherein the server stores manufacture's change information on a replacement part, and includes a control unit that, when identification information of the replacement part is detected, controls a notification of the change information on a replacement part to be made to a user.

31. An image forming apparatus according to claim 17, further comprising a control unit that controls a life warning notification at the time when a replacement part reaches a life end to be changed into a predetermined time from a usage state of the replacement part.

32. An image forming apparatus according to claim 17, further comprising a control unit that, when the image forming apparatus is changed into a new generation model by replacing at least one part with a new part, controls software corresponding to the new generation model to be installed.

33. A management method for a replacement part in which the replacement part detachably mountable to an apparatus main body is managed by communicating information through a communication unit between a control unit of the apparatus main body and a storage medium of the replacement part capable of storing the information, the method comprising:

storing identification information inherent to the replacement part into the storage medium of the replacement part;

in correspondence with the identification information, storing information for managing a usage state of the replacement part into a storage unit provided to an element other than the replacement part;

reading the identification information of the replacement part stored in the storage medium of the replacement part;

based on the identification information read from the replacement part, acquiring the information on a corresponding replacement part stored in the storage unit; and based on the information on the corresponding replacement part acquired from the storage unit, managing a usage state of the replacement part.

34. A management program for a replacement part for allowing a computer to execute a process of managing the replacement part detachably mountable to an apparatus main body by communicating information through a communication unit between a control unit of the apparatus main body and a storage medium of the replacement part capable of storing the information, the method comprising:

reading identification information of the replacement part stored in the storage medium of the replacement part;

based on the identification information read from the replacement part, acquiring the information on a corresponding replacement part stored in a storage unit provided to an element other than the replacement part; and based on the information on the corresponding replacement part acquired from the storage unit, managing a usage state of the replacement part.

* * * * *